US010415215B2

(12) United States Patent
Takahashi et al.

(10) Patent No.: US 10,415,215 B2
(45) Date of Patent: Sep. 17, 2019

(54) DRIVE SYSTEM FOR CONSTRUCTION MACHINE

(71) Applicant: Hitachi Construction Machinery Co., Ltd., Taito-ku, Tokyo (JP)

(72) Inventors: Hiromasa Takahashi, Abiko (JP); Kenji Hiraku, Kasumigaura (JP); Juri Shimizu, Tsuchiura (JP); Shohei Sugiki, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 91 days.

(21) Appl. No.: 15/848,051

(22) Filed: Dec. 20, 2017

(65) Prior Publication Data

US 2018/0251960 A1 Sep. 6, 2018

(30) Foreign Application Priority Data

Mar. 1, 2017 (JP) ..... 2017-038420

(51) Int. Cl.
*E02F 9/22* (2006.01)
*F15B 20/00* (2006.01)

(52) U.S. Cl.
CPC ..... *E02F 9/2232* (2013.01); *E02F 9/2235* (2013.01); *E02F 9/2296* (2013.01); *F15B 20/00* (2013.01); *F15B 2211/20515* (2013.01); *F15B 2211/30595* (2013.01);
(Continued)

(58) Field of Classification Search
CPC ..... E02F 9/2232; E02F 9/2235; F15B 20/00
See application file for complete search history.

(56) References Cited

U.S. PATENT DOCUMENTS 4,369,625 A * 1/1983 Izumi ..... E02F 9/2292 414/699
6,502,499 B2 * 1/2003 Sannomiya ..... E02F 9/2217 91/436
9,903,094 B2 * 2/2018 Takahashi ..... E02F 9/2235
(Continued)

FOREIGN PATENT DOCUMENTS

JP 2014-205977 A 10/2014

*Primary Examiner* — Thomas E Lazo
(74) *Attorney, Agent, or Firm* — Crowell & Moring LLP

(57) ABSTRACT

A drive system for a construction machine capable of appropriately controlling a distribution flow rate to each hydraulic actuator and improving operability by an operator is provided. A flow rate distribution section that computes a distribution flow rate of a hydraulic fluid supplied to each of a plurality of hydraulic actuators on the basis of a demanded flow rate, sets, within a distributable region set for computing a range of a distributable flow rate that is a flow rate of the hydraulic fluid suppliable to each of at least two hydraulic actuators driven by a combined operation among the plurality of hydraulic actuators from a plurality of hydraulic pump devices for the at least two hydraulic actuators, a distribution region for computing a range of the distribution flow rate of the hydraulic fluid actually supplied to each of the at least two hydraulic actuators, and computes the distribution flow rate in such a manner that the distribution flow rate falls within the distribution region and a ratio among the distribution flow rates of the plurality of hydraulic actuators is equal to a ratio among the demanded flow rates of the plurality of hydraulic actuators.

5 Claims, 21 Drawing Sheets

(52) U.S. Cl.
CPC ..... *F15B 2211/6654* (2013.01); *F15B 2211/7056* (2013.01); *F15B 2211/7142* (2013.01)

(56) References Cited

U.S. PATENT DOCUMENTS

| | | | | |
|---|---|---|---|---|
| 9,938,691 | B2 * | 4/2018 | Hiraku | F15B 11/17 |
| 2016/0208459 | A1 * | 7/2016 | Takahashi | E02F 9/2235 |
| 2017/0227028 | A1 * | 8/2017 | Ueda | F15B 11/17 |
| 2018/0245312 | A1 * | 8/2018 | Sugano | E02F 9/22 |

* cited by examiner

FIG. 6

| | BOOM | ARM | BUCKET | SWING |
|---|---|---|---|---|
| PUMP $10_a$ | 1 | 2 | 3 | 4 |
| PUMP 10b | 2 | 3 | 4 | 1 |
| PUMP 10c | 3 | 4 | 1 | 2 |
| PUMP 10d | 4 | 1 | 2 | 3 |

33a

DRIVE SYSTEM FOR CONSTRUCTION MACHINE

BACKGROUND OF THE INVENTION

1. Field of the Invention

The present invention relates to a drive system for a construction machine.

2. Description of the Related Art

In recent years, the energy saving of construction machines has been desired with the raising of environmental awareness. Importance is placed particularly on the energy saving of a hydraulic system for driving a construction machine, and there have been proposed various hydraulic systems such as a hybrid system that, for example, recovers and reuses braking power of a swing motor.

Furthermore, there is known a technique described in, for example, JP-2014-205977-A as one that pays attention to a throttle pressure loss generated in control valves and the like of a hydraulic system. According to this technique, closed-circuit connection is established between a plurality of hydraulic pumps and a plurality of hydraulic actuators via not control valves but solenoid selector valves each for communication or interruption of a flow passage. In addition, the connection between the plurality of hydraulic pumps and the plurality of hydraulic actuators via the solenoid selector valves is set on the basis of operation signals generated by an operation device to the hydraulic actuators, and delivery flow rates of the hydraulic pumps are changed. A speed of each hydraulic actuator is thereby controlled.

SUMMARY OF THE INVENTION

According to the above conventional technique, a necessary flow rate (demanded flow rate) of each hydraulic actuator is calculated in response to a lever operation amount by an operator, and the connection between the plurality of hydraulic actuators and the plurality of hydraulic pumps is set on the basis of a connection pattern that specifies priorities of the connection between the hydraulic actuators and the hydraulic pumps in advance and the necessary flow rate.

However, when a plurality of hydraulic actuators are operated simultaneously, for example, the hydraulic pumps in number that enables the supply of the necessary flow rate to each hydraulic actuator are not always connected to the hydraulic actuator depending on an operation situation. Owing to this, even if the operation device is operated in a state in which the necessary flow rate of a certain hydraulic actuator exceeds a maximum delivery amount preset to each of the hydraulic pumps connected to the hydraulic actuator, a supply flow rate to the hydraulic actuator does not change to follow the necessary flow rate. As a result, a problem occurs that an operating speed of each hydraulic actuator and a change of the operating speed do not necessarily match the intention of the operator and operability by the operator disadvantageously decreases.

The present invention has been achieved in the light of the aforementioned, and an object of the present invention is to provide a drive system for a construction machine capable of improving operability by an operator by appropriately controlling a distribution flow rate to each hydraulic actuator.

The present application includes a plurality of means for solving the problems described above. As one example, a drive system for a construction machine, includes: a plurality of hydraulic actuators; a plurality of pump devices connected to the plurality of hydraulic actuators via a plurality of hydraulic lines, and delivering hydraulic fluids in response to an operation amount of an operation device; a plurality of hydraulic valves provided in the plurality of hydraulic lines, and changing over flows of the plurality of hydraulic lines in such a manner that the hydraulic fluids delivered from the plurality of pump devices are selectively supplied to the plurality of hydraulic actuators; and a controller that controls the pump devices and the hydraulic valves in response to the operation amount of the operation device. Further, the controller includes: a demanded flow rate computing section that computes a demanded flow rate of each of the plurality of hydraulic actuators in response to the operation amount of the operation device; a flow rate distribution section that computes a distribution flow rate of the hydraulic fluid supplied to each of the plurality of hydraulic actuators on the basis of the demanded flow rate; and a pump allocation computing section that computes a delivery flow rate of each of the plurality of pump devices in response to the distribution flow rate. Further, the flow rate distribution section includes: a distribution region setting section that sets a distributable region for computing a range of a distributable flow rate that is a flow rate of the hydraulic fluid suppliable to each of at least two hydraulic actuators driven by a combined operation among the plurality of hydraulic actuators from the plurality of hydraulic pump devices for the at least two hydraulic actuators, and that sets a distribution region within the distributable region for computing a range of the distribution flow rate of the hydraulic fluid actually supplied to each of the at least two hydraulic actuators; and a ratio distribution section that computes the distribution flow rate in such a manner that when at least the demanded flow rate is out of the distributable region, the distribution flow rate falls within the distribution region and a ratio between the distribution flow rates of the at least two hydraulic actuators is equal to a ratio between the demanded flow rates of the at least two hydraulic actuators.

Advantage of the Invention

According to the present invention, it is possible to appropriately control a distribution flow rate to each hydraulic actuator and to improve operability by an operator.

BRIEF DESCRIPTION OF THE DRAWINGS

FIG. 6 shows an example of a priority connection table used in a pump allocation computing section;

DESCRIPTION OF THE PREFERRED EMBODIMENTS

Embodiments of the present invention will be described hereinafter with reference to the drawings. While a hydraulic excavator that includes a bucket 3 on a tip end of a work machine (front work implement) will be described as a construction machine in the present embodiments, the present invention can be applied to a hydraulic excavator that includes an attachment other than the bucket. Furthermore, the present invention can be applied to a construction machine other than the hydraulic excavator if the construction machine includes a hydraulic system that controls a connection relationship between a plurality of hydraulic actuators and a plurality of hydraulic pumps.

In the following description, when a plurality of same constituent elements are present, alphabets are often added to the ends of symbols (numbers). However, the plurality of constituent elements are often denoted generically while omitting the alphabets. That is, when four hydraulic pumps 10*a*, 10*b*, 10*c*, and 10*d* are present, for example, these hydraulic pumps are often generically denoted by hydraulic pumps 10. In addition, signal lines and the like among which a connection relationship is obvious by description are not often shown.

First Embodiment

A first embodiment of the present invention will be described with reference to FIGS. 1 to 12.

Figure 1:
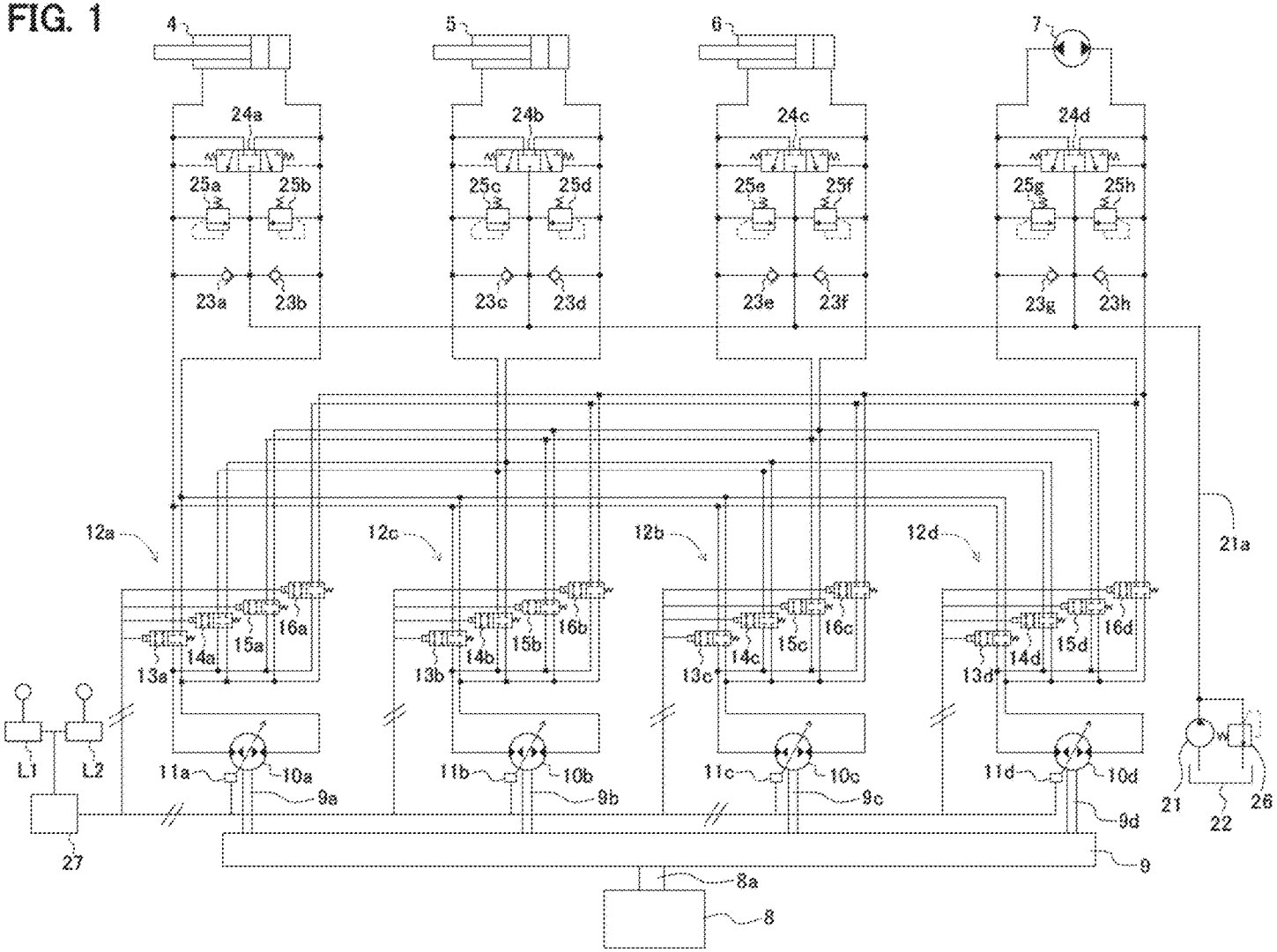
FIG. 1 shows a drive system for a hydraulic excavator according to a first embodiment along with a controller therefor.
Figure 2:
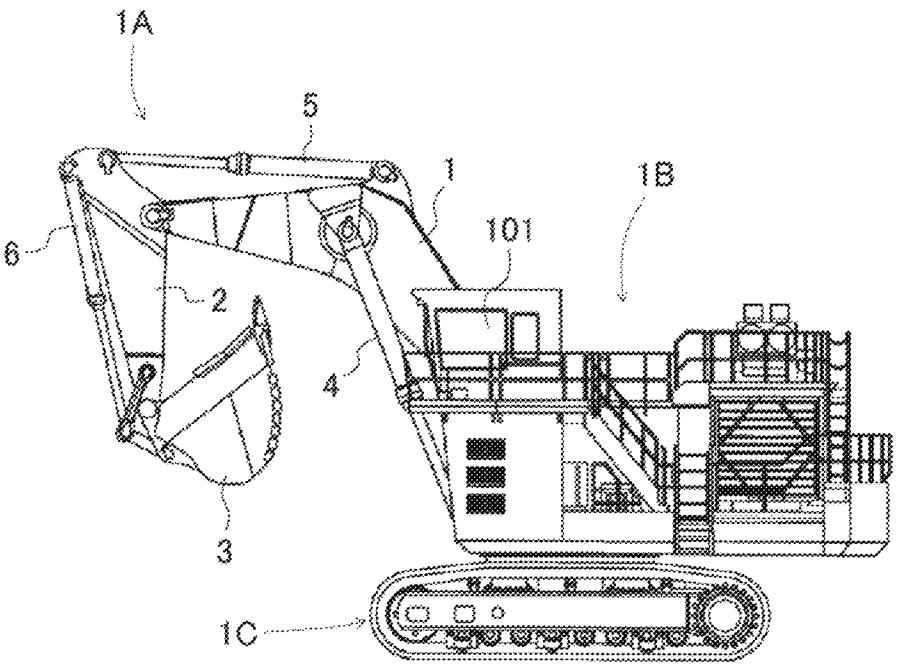
FIG. 2 is an external view of the hydraulic excavator that is an example of a construction machine to which the present invention is applied.

FIG. 1 shows a drive system for a hydraulic excavator according to a first embodiment along with a controller therefor. FIG. 2 is an external view of a hydraulic excavator that is an example of a construction machine to which the present invention is applied. It is noted that FIG. 1 shows a standby state (case of no lever operation).

In FIG. 1, the hydraulic excavator to which the present invention is applied includes a gearbox 9 that transmits drive power composed of a torque input to a shaft 8*a* and a revolution speed to a plurality of shafts 9*a* to 9*d*; double-tilting variable displacement hydraulic pumps 10*a* to 10*d* each of which is driven by a prime mover 8 such as an engine or an electric motor via the gearbox 9 and has two input or output ports; a single-tilting fixed displacement charge pump 21 that is driven by the prime mover 8 via a power transmission mechanism which is not shown; regulators 11*a* to 11*d* that control swash plate angles of the hydraulic pumps 10*a* to 10*d* and control delivery capacities thereof on the basis of control signals (pump commands); a plurality of hydraulic actuators such as a boom cylinder 4, an arm cylinder 5, a bucket cylinder 6, and a swing motor 7 driven by hydraulic working fluids delivered from the hydraulic pumps 10*a* to 10*d*; a plurality of hydraulic valve groups 12*a* to 12*d* provided on a plurality of lines (hydraulic lines) connecting the plurality of hydraulic pumps 10*a* to 10*d* to the plurality of hydraulic actuators 4 to 7, and changing over supply destinations of the hydraulic fluids delivered from the plurality of hydraulic pumps 10*a* to 10*d* to the plurality of hydraulic actuators 4 to 7 on the basis of control signals (valve commands); a plurality of operation levers (operation devices) L1 and L2 for operating the plurality of hydraulic actuators 4 to 7; a controller 27 that controls the hydraulic valve groups 12*a* to 12*d* and the regulators 11*a* to 11*d* on the basis of an operation amount of the operation levers L1 and L2 operated by an operator (lever operation amount), a detection result of a pressure sensor which is not shown, and the like; and a travel motor that is not shown. These elements configure a hydraulic drive system that drives driven members of the hydraulic excavator. Furthermore, the hydraulic pumps 10*a* to 10*d* and the regulators 11*a* to 11*d* configure a plurality of pump devices that deliver the hydraulic fluids in response to the operation amount of the operation devices L1 and L2 operated by the operator. For brevity, description will be given on the assumption that maximum delivery flow rates of the hydraulic pumps 10*a* to 10*d* are all equal.

The hydraulic valve groups 12*a* to 12*d* are intended to establish hydraulic closed-circuit connection between the plurality of hydraulic actuators 4 to 7 and at least one or more of the hydraulic pumps 10*a* to 10*d*, and change over connection states of the lines in such a manner that the hydraulic fluid delivered from each of the hydraulic pumps 10*a* to 10*d* is supplied to any one of the plurality of hydraulic actuators 4 to 7 on the basis of the control signals (valve commands) from the controller 27.

The hydraulic valve group 12*a* selectively changes over connection such that the hydraulic pump 10*a* configures a closed circuit along with any one of the plurality of hydraulic actuators 4 to 7, and is configured with a plurality of hydraulic valves 13*a* to 16*a*. The plurality of hydraulic valves 13*a* to 16*a* are solenoid selector valves each of which changes over between interruption and communication of the line on the basis of the control signal from the controller 27. The hydraulic valves 13*a* to 16*a* change over between interruption and communication of the closed-circuit connection between the hydraulic pump 10*a* and the plurality of hydraulic actuators 4 to 7. That is, the hydraulic valve 13*a* changes over between interruption and communication of the closed-circuit connection between the hydraulic pump 10*a* and the boom cylinder 4, the hydraulic valve 14*a* changes over between interruption and communication of the closed-circuit connection between the hydraulic pump 10*a* and the arm cylinder 5, the hydraulic valve 15*a* changes over between interruption and communication of the closed-circuit connection between the hydraulic pump 10*a* and the bucket cylinder 6, and the hydraulic valve 16*a* changes over between interruption and communication of the closed-circuit connection between the hydraulic pump 10*a* and a swing motor 7. For example, when the hydraulic valve 13*a* is controlled into an open state and the other hydraulic valves 14*a* to 16*a* are controlled into a closed state, the closed-circuit connection is established between the hydraulic pump 10*a* and the boom cylinder 4. The hydraulic valves 13*a* to 16*a* are each a normally closed solenoid selector valve that interrupts the line in a standby state in which the control signal is not input, and communicates the line when a control signal as a valve opening command is input from the controller 27.

The other hydraulic valve groups 12*b* to 12*d* are similar to the hydraulic valve group 12*a*. That is, the hydraulic valve groups 12*b* to 12*d* are configured from a plurality of hydraulic valves 13*b* to 16*b*, 13*c* to 16*c*, and 13*d* to 16*d*, which are solenoid selector valves, and change over between interruption and communication of the closed-circuit connection between the hydraulic pumps 10*b* to 10*d* and the plurality of hydraulic actuators 4 to 7 on the basis of the control signals from the controller 27.

Makeup valves 23*a* to 23*h* that replenish hydraulic closed circuits of the hydraulic actuators 4 to 7 with the hydraulic fluids supplied from the charge pump 21 to a charge line 21*a*, main relief valves 25*a* to 25*h* that relieve the hydraulic fluids to the charge line 21*a* when pressures of the hydraulic closed circuits become equal to or higher than a set pressure, and flushing valves 24*a* to 24*d* that discharge to the charge line 21*a* excessive fluids in the hydraulic closed circuits generated by a pressure-receiving area difference between a head chamber and a rod chamber of, for example, each of the hydraulic cylinders 4 to 6 among the hydraulic actuators 4 to 7 or the like are provided downstream of the hydraulic valve groups 12*a* to 12*d* in hydraulic closed circuits of the hydraulic actuators 4 to 7. The main relief valves 25*a* to 25*h* determine maximum pressures of the hydraulic closed circuits. A charge relief valve 26 that relieves the excessive fluids to a hydraulic fluid tank 22 while keeping a pressure of the charge line 21*a*, to which the hydraulic fluids are supplied from the charge pump 21, to a set pressure is provided in the charge line 21*a*, and the charge relief valve 26 determines a maximum pressure of the charge line 21*a*.

As shown in FIG. 2, the hydraulic excavator is configured with a multijoint type front implement 1A configured by coupling the boom 1, the arm 2, and the bucket 3 each rotating in a vertical direction, an upper swing structure 1B, and a lower travel structure 1C. A base end of the boom 1 of the front implement 1A is rotatably supported by a front portion of the upper swing structure 1B, one end of the arm 2 is rotatably supported by an end portion (tip end) other than the base end of the boom 1, and the bucket 3 is rotatably supported by the other end of the arm 2. The boom 1, the arm 2, the bucket 3, the upper swing structure 1B, and the lower travel structure 1C are driven by the boom cylinder 4, the arm cylinder 5, the bucket cylinder 6, the swing motor 7, and left and right travel motors which are not shown, respectively.

The operation levers (operation devices) L1 and L2 that output operation signals for operating the hydraulic actuators 4 to 7 are provided in a cabin 101 in which the operator is on board. The operation levers L1 and L2, although not shown in FIG. 2, are tiltable longitudinally and horizontally, include a sensor, not shown, for electrically sensing a lever tilt amount, that is, a lever operation amount that is an operation signal, and output the lever operation amount detected by the sensor to the controller 27 via an electric interconnection. That is, in the present embodiment, an operation on each of the hydraulic actuators 4 to 7 is allocated to a longitudinal direction or a horizontal direction of the operation levers L1 and L2.

Figure 3:
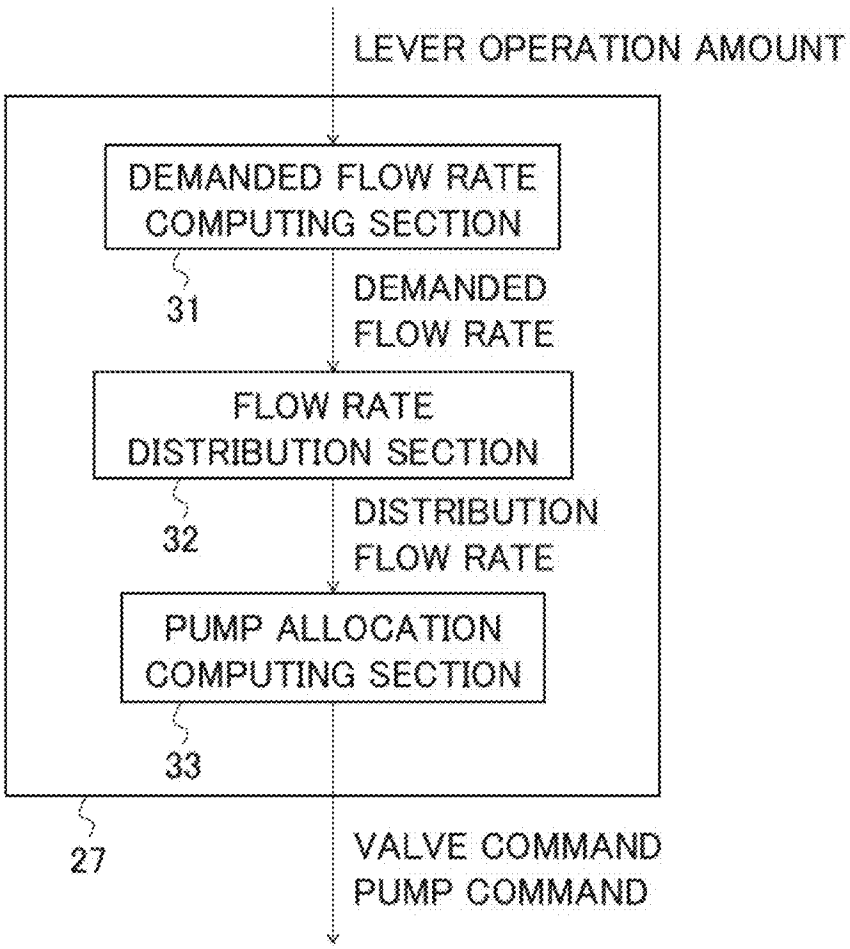
FIG. 3 is a functional block diagram showing control functions of a controller.
Figure 4:
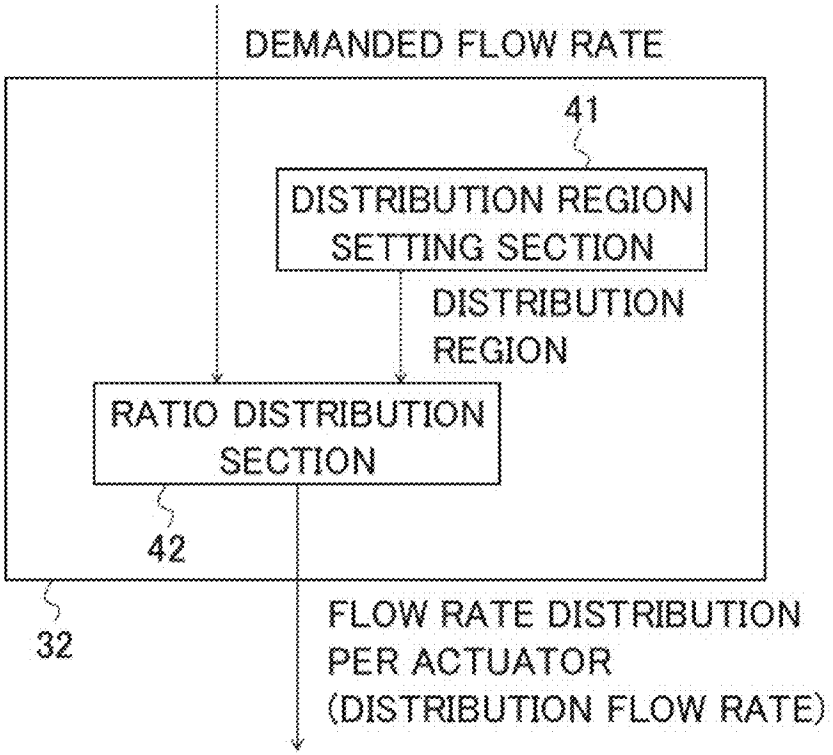
FIG. 4 is a functional block diagram showing processing functions of a flow rate distribution section of the controller.

FIG. 3 is a functional block diagram showing control functions of the controller. FIG. 4 is a functional block diagram showing processing functions of a flow rate distribution section of the controller.

In FIG. 3, the controller 27 includes: a demanded flow rate computing section 31 that computes demanded flow rates (in other words, demanded speeds) of the plurality of hydraulic actuators 4 to 7 in response to the lever operation amount input from the operation levers L1 and L2; a flow rate distribution section 32 that computes flow rates of the hydraulic fluids (hereinafter, referred to as "distribution flow rates") supplied to the plurality of hydraulic actuators 4 to 7 on the basis of the demanded flow rates; and a pump allocation computing section 33 that computes delivery flow rates of the plurality of hydraulic pumps 10*a* to 10*d* in response to the distribution flow rates, and output the delivery flow rates as control signals (pump commands) to the plurality of hydraulic pumps 10*a* to 10*d* and control signals (valve commands) to the hydraulic valve groups 12*a* to 12*d*.

In FIG. 4, the flow rate distribution section 32 includes: a distribution region setting section 41 that sets a distributable region 52 for computing a range of distributable flow rates that are flow rates of the hydraulic fluids suppliable to at least two hydraulic actuators (for example, the boom cylinder 4 and the arm cylinder 5) driven by a combined operation among the plurality of hydraulic actuators 4 to 7 from the plurality of hydraulic pumps 10*a* to 10*d* for the at least two hydraulic actuators, and that sets a distribution region 53 within the distributable region 52 for computing distribution flow rates of the hydraulic fluids supplied to the at least two hydraulic actuators; and a ratio distribution section 42 that computes the distribution flow rates in such a manner that the distribution flow rates fall within the distribution region 53 and a ratio between the distribution flow rates to the at least two hydraulic actuators is equal to a ratio between the demanded flow rates of the at least two hydraulic actuators when at least a demanded flow rate is out of the range of the distributable region 52.

FIGS. 5A to 5D each show a relationship between the operation amount of the operation levers and the demanded flow rate used in the demanded flow rate computing section.

Figure 5A:
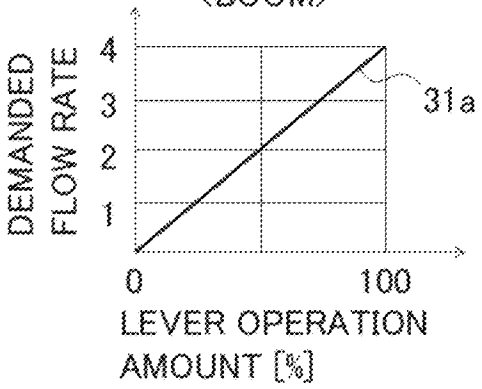
FIG. 5A shows a relationship between an operation amount of operation levers and a demanded flow rate of a boom cylinder used in a demanded flow rate computing section.
Figure 5B:
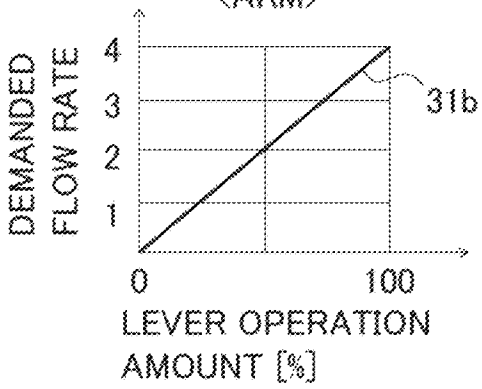
FIG. 5B shows a relationship between an operation amount of the operation levers and a demanded flow rate of an arm cylinder used in the demanded flow rate computing section.
Figure 5C:
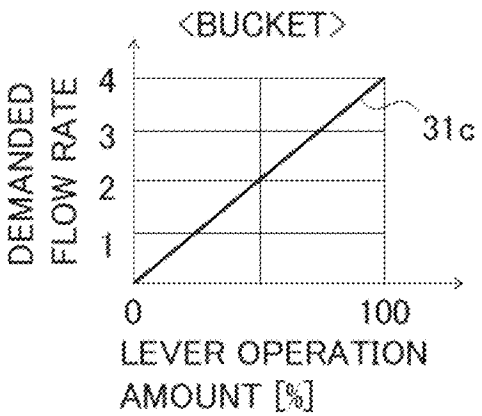
FIG. 5C shows a relationship between an operation amount of operation levers and a demanded flow rate of a bucket cylinder used in the demanded flow rate computing section.
Figure 5D:
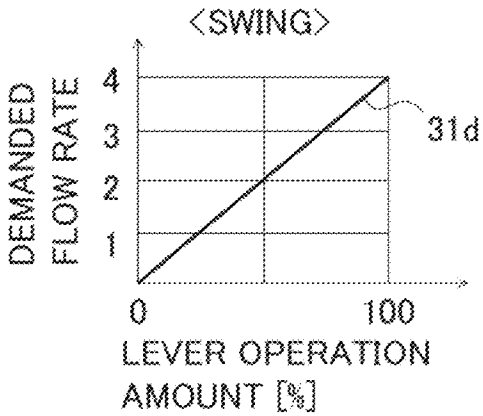
FIG. 5D shows a relationship between an operation amount of the operation levers and a demanded flow rate of a swing motor used in the demanded flow rate computing section.

In FIGS. 5A to 5D, FIG. 5A shows a relationship 31*a* between the lever operation amount in a direction corresponding to the boom cylinder 4 and the demanded flow rate of the boom cylinder 4, and FIG. 5B shows a relationship 31*b* between the lever operation amount in a direction corresponding to the arm cylinder 5 and the demanded flow rate of the arm cylinder 5. FIG. 5C shows a relationship 31*c* between the lever operation amount in a direction corresponding to the bucket cylinder 6 and the demanded flow rate of the bucket cylinder 6, and FIG. 5D shows a relationship 31*d* between the lever operation amount in a direction corresponding to the swing motor 7 and the demanded flow rate of the swing motor 7. The relationships 31*a* to 31*d* between the operation amounts of the operation levers L1 and L2 (lever operation amounts) and the demanded flow rates shown in FIGS. 5A to 5D are stored in the demanded flow rate computing section 31 in advance, and used when the demanded flow rates of the hydraulic actuators 4 to 7 are computed in response to the lever operation amounts input from the operation levers L1 and L2.

In FIGS. 5A to 5D, when the operation amount of the operation levers L1 and L2 is 0(%) (that is, when the operation levers L1 and L2 are not operated), the demanded flow rate of each of the hydraulic actuators 4 to 7 is 0. As the operation amount of the operation levers L1 and L2 increases from 0(%), the demanded flow rate increases. When the operation amount of the operation levers L1 and L2 is equal to 100(%), the demanded flow rate is equal to 4. The demanded flow rate which is 4 represents that flow rates of the four hydraulic pumps 10*a* to 10*d* at the maximum delivery flow rates are demanded.

The distributable region 52 is set for computing the range of the flow rates of the hydraulic fluids theoretically suppliable to the actuators, while the distribution region 53 for computing the range of the distribution flow rates actually supplied to the actuators is set to fall within the distributable region 52. The distribution region 53 set for the distribution region setting section 41 is used for computing the distribution flow rates of the hydraulic fluids supplied to the plurality of hydraulic actuators 4 to 7. When a point determined by the distribution flow rates to the plurality of hydraulic actuators 4 to 7 is assumed as a distribution flow rate=(x, y, z, w) in a coordinate system in which the distribution flow rates to the hydraulic actuators 4 to 7 are set to coordinate axes (for example, an x-axis, a y-axis, a z-axis, and a w-axis), the ratio distribution section 42 computes a range of possible values of the distribution flow rate=(x, y, z, w). That is, the distribution flow rate=(x, y, z, w) is limited to a range of the distribution region 53 in computation by the ratio distribution section 42. It is noted that the distribution region 53 is set to fall within a range of the distributable region 52 and an arbitrary range of the distributable region 52 can be set in advance as needed. The present embodiment exemplarily describes a case in which, for the distribution region setting section 41, the range of the distribution region 53 is set equal to the range of the distributable region 52. Various other ranges may be considered as the range of the distribution region 53 set for the distribution region setting section 41. For example, the distribution region setting section 41 can set the distribution region 53 such that a maximum value that is a sum of the distribution flow rates set to the plurality of hydraulic actuators within a range of the distribution region 53 is constant irrespective of the ratio among the demanded flow rates of the plurality of hydraulic actuators. Alternatively, the distribution region setting section 41 can set the distribution region 53 such that a speed of the arm cylinder 5 tends to decrease (in other words, a declining rate of the distribution flow rate increases) as the lever operation amount (demanded flow rate) related to the boom cylinder 4 increases from a value that indicates a fine operation. The distributable region 52 is a region of distribution flow rates specified on the basis of the distributable flow rates that are the flow rates of the hydraulic fluids suppliable to the plurality of hydraulic actuators 4 to 7 from the plurality of hydraulic pumps 10*a* to 10*d*. That is, the distributable region 52 represents a range of the distribution flow rate=(x, y, z, w) of the hydraulic fluids suppliable to the plurality of hydraulic actuators 4 to 7 when combinations in which the closed-circuit connection can be established between the plurality of hydraulic pumps 10*a* to 10*d* and the plurality of hydraulic actuators 4 to 7 by the hydraulic valve groups 12*a* to 12*d* and the flow rates (minimum delivery flow rates to maximum delivery flow rates) that can be delivered by the plurality of hydraulic pumps 10*a* to 10*d* are considered.

The computation of the delivery flow rates of the hydraulic pumps 10*a* to 10*d* by the pump allocation computing section 33 includes, at the same time, pump allocation for allocating the hydraulic pumps 10*a* to 10*d* supplying the hydraulic fluids to the hydraulic actuators 4 to 7.

FIG. 6 shows an example of a priority connection table used in the pump allocation computing section.

In FIG. 6, a priority connection table 33*a* defines priorities of the hydraulic pumps 10*a* to 10*d* connected to the hydraulic actuators 4 to 7, and is used as criteria for determining from which of the hydraulic pumps 10*a* to 10*d* the hydraulic fluids at the distribution flow rates to the hydraulic actuators 4 to 7 computed by the flow rate distribution section 32 are supplied. The priority connection table 33*a* indicates priorities of the hydraulic pumps 10*a* to 10*d* from the perspective of the hydraulic actuators 4 to 7 and also indicates priorities of the hydraulic actuators 4 to 7 from the perspective of the hydraulic pumps 10*a* to 10*d*. From the perspective of the hydraulic actuator, for example, from the perspective of the boom cylinder 4, the priority of the hydraulic pump 10*a* is a highest priority and that of the hydraulic pump 10*d* is a fourth highest priority. Furthermore, from the perspective of the hydraulic pump, for example, from the perspective of the hydraulic pump 10*a*, the priority of the boom cylinder 4 is a highest priority and that of the swing motor 7 is a fourth highest priority.

The pump allocation computing section 33 computes pump allocation of the hydraulic pumps 10*a* to 10*d* and the delivery flow rates of the hydraulic pumps 10*a* to 10*d* on the basis of the distribution flow rates computed by the flow rate distribution section 32 and the priority connection table 33*a*, outputs the delivery flow rates of the hydraulic pumps 10*a* to 10*d* as the control signals (pump commands), and outputs connection settings of the closed-circuit connection between the hydraulic actuators 4 to 7 and the hydraulic pumps 10*a* to 10*d* in response to the pump allocation as the control signals (valve commands) to the hydraulic valve groups 12*a* to 12*d*.

Figure 7:
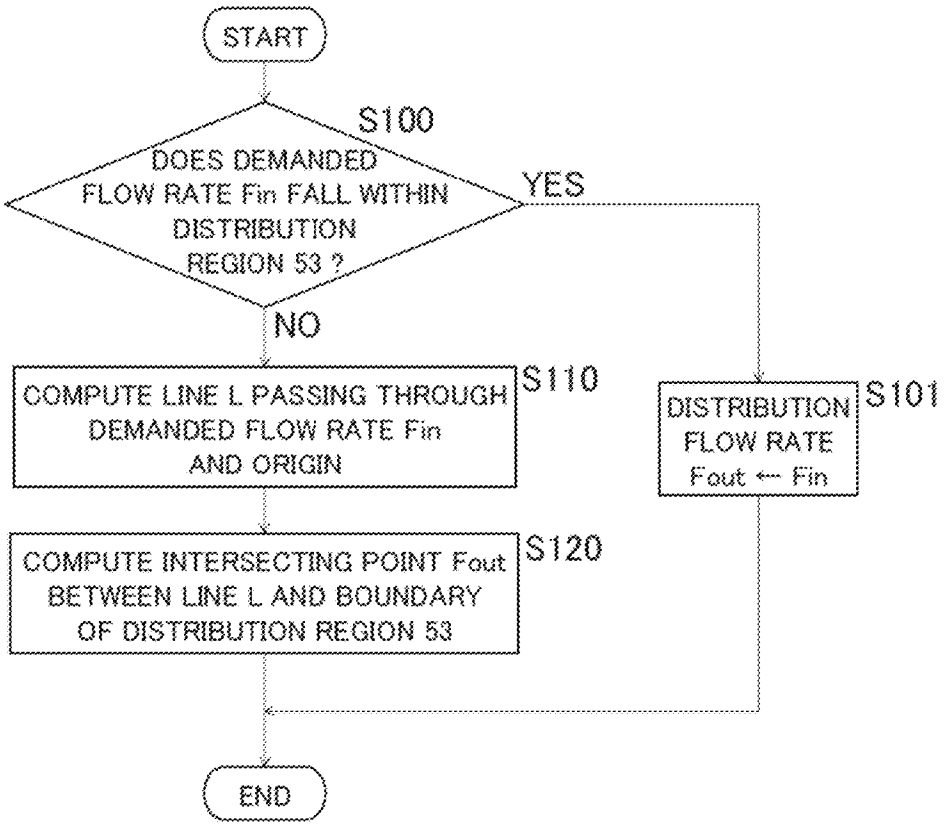
FIG. 7 is a flowchart showing a series of processes by the flow rate distribution section.
Figure 8:
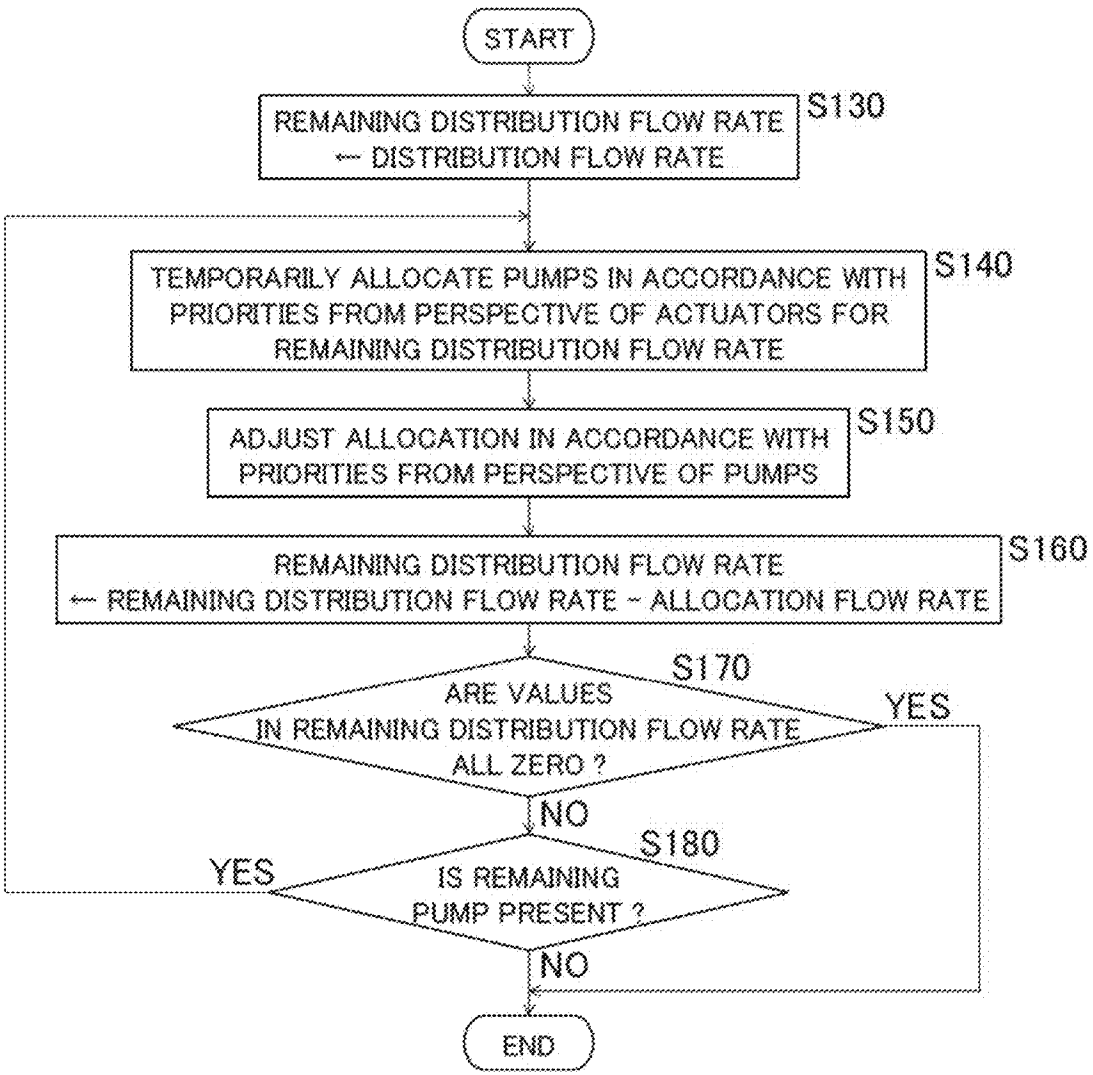
FIG. 8 is a flowchart showing a series of processes by the pump allocation computing section.
Figure 9:
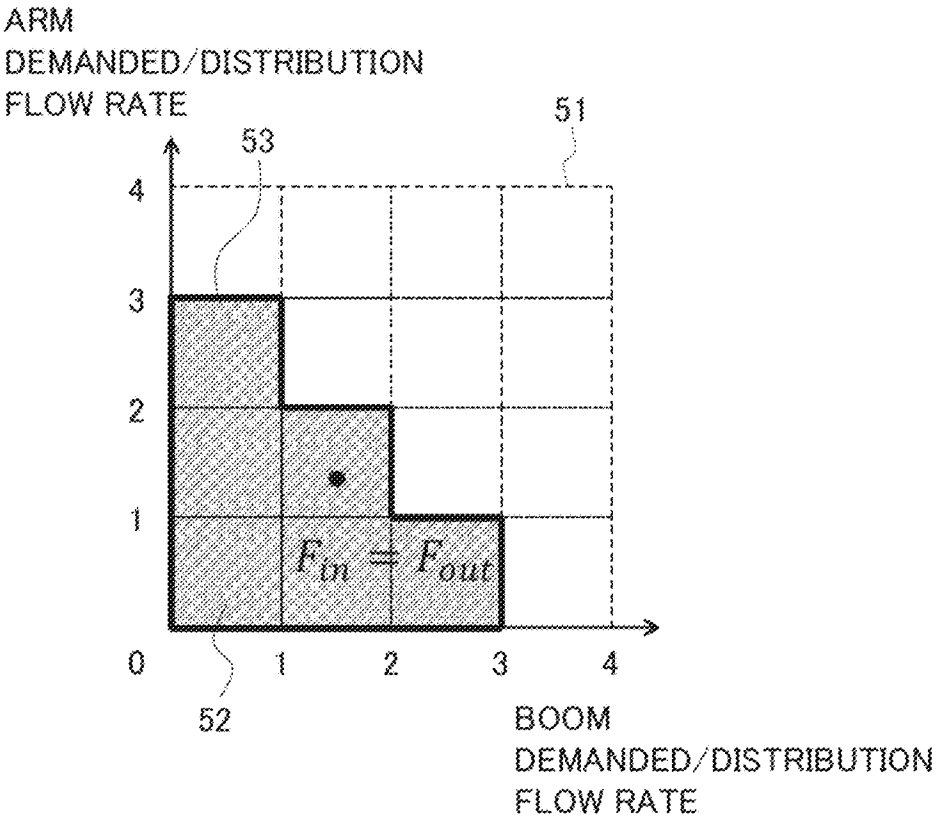
FIG. 9 is a conceptual explanatory diagram of a relationship between a demanded flow rate and a distribution flow rate.
Figure 10:
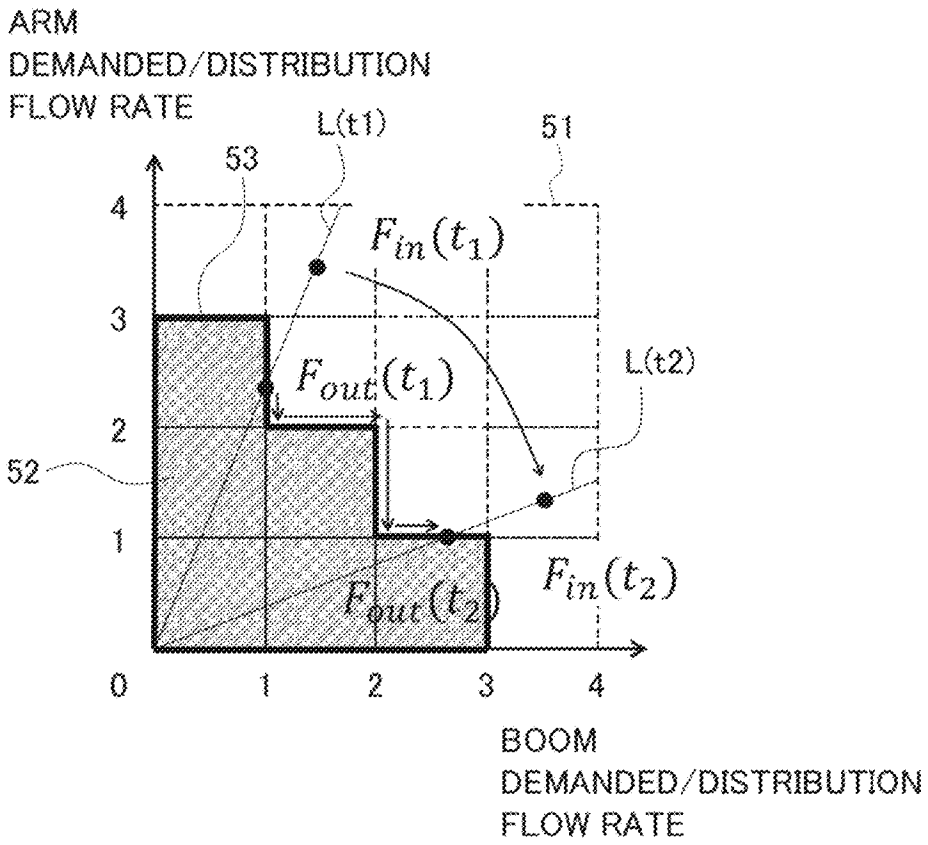
FIG. 10 is a conceptual explanatory diagram of the relationship between the demanded flow rate and the distribution flow rate.

FIGS. 7 and 8 are flowcharts showing series of processes by the flow rate distribution section and the pump allocation computing section, respectively. In addition, FIGS. 9 and 10 are conceptual explanatory diagrams of the relationship between the demanded flow rate and the distribution flow rate, and show a case of considering the combined operation of the arm cylinder 5 and the boom cylinder 4 by way of example. It is noted that FIG. 9 shows a case in which values of the demanded flow rates fall within the range (including a boundary) of the distribution region 53, while FIG. 10 shows a case in which the values of the demanded flow rates are out of the range of the distribution region 53.

In FIGS. 9 and 10, each axis of a coordinate system indicates the demanded flow rate and the distribution flow rate for each hydraulic actuator. Specifically, a vertical axis indicates the demanded flow rate and the distribution flow rate for the arm cylinder 5, and a horizontal axis indicates the demanded flow rate and the distribution flow rate for the boom cylinder 4. Furthermore, FIGS. 9 and 10 represent how many hydraulic pumps at the maximum delivery flow rates the values of the demanded flow rates and the distribution flow rates correspond to. For example, when the value of the demanded flow rate (or distribution flow rate) is 1.5, the demanded flow rate (or distribution flow rate) represents flow rates of 1.5 hydraulic pumps at the maximum delivery flow rates. FIGS. 9 and 10 also show a demandable region 51 that is a range of possible values of the demanded flow rate of each hydraulic cylinder, the distributable region 52 (hatched region), and the distribution region 53 (region surrounded by a thick line). FIGS. 9 and 10 show the case in which the range of the distribution region 53 is set equal to the range of the distributable region 52, as described above. Although not shown in FIGS. 9 and 10 in which the combined operation of the arm cylinder 5 and the boom cylinder 4 is considered, ranges covering values 3 to 4 on the vertical axis and the horizontal axis could be valid as a region in which the hydraulic fluid is supplied to a certain hydraulic actuator when an independent operation of each of the hydraulic actuators 4 to 7 is considered.

In FIG. 7, the flow rate distribution section 32 determines whether a demanded flow rate Fin in the combined operation of the arm cylinder 5 and the boom cylinder 4 falls within the range (including the boundary) of the distribution region 53 (Step S100). When a determination result of Step S100 is YES, the flow rate distribution section 32 uses the demanded flow rate Fin as a computation result of a distribution flow rate Fout (Step S101) and ends the processes. When the determination result of Step S100 is NO, that is, when the demanded flow rate Fin is out of the range of the distribution region 53, the flow rate distribution section 32 computes a line L that passes through an origin of the coordinate system and the demanded flow rate Fin (Step S110), uses an intersecting point between the line L and the boundary of the distribution region 53 as the computation result of the distribution flow rate Fout (Step S120), and ends the processes.

In FIG. 8, first, the pump allocation computing section 33 sets the distribution flow rate computed by the flow rate distribution section 32 to a remaining distribution flow rate (Step S130). Next, the pump allocation computing section 33 temporarily allocates the hydraulic pumps to the hydraulic actuators in accordance with the priorities from the perspective of the hydraulic actuators for the remaining distribution flow rate (Step S140), then adjusts the allocation of the hydraulic pumps in accordance with the priorities from the perspective of the hydraulic pumps, and allocates the redundantly allocated hydraulic pumps to the hydraulic actuator having a higher priority from the perspective of the hydraulic pumps (Step S150). Subsequently, the pump allocation computing section 33 updates the remaining distribution flow rate to a flow rate obtained by removing the allocation flow rate (distribution flow rate for which the allocation of the hydraulic pumps is over) from the remaining distribution flow rate, as a new remaining distribution flow rate (Step S160). Here, the pump allocation computing section 33 determines whether all values in the remaining distribution flow rate are zero (Step S170). When a determination result is YES, the pump allocation computing section 33 ends the processes. When the determination result in Step S170 is NO, the pump allocation computing section 33 determines whether remaining pumps (hydraulic pumps that are not determined to be allocated) are present (Step S180). When a determination result is NO, the pump allocation computing section 33 returns to the process in Step S140. When the determination result is YES, the pump allocation computing section 33 ends the processes.

Contents of the processes by the demanded flow rate computing section 31, the flow rate distribution section 32, and the pump allocation computing section 33 will now be described more specifically.

For example, when the combined operation is performed such that the lever operation amount for the boom cylinder 4 is 40% and the lever operation amount for the arm cylinder 5 is 30%, then the demanded flow rate computing section 31 computes the demanded flow rate of the boom cylinder 5 as represented by 4×0.4=1.6 (see FIG. 5A), and the demanded flow rate of the arm cylinder 5 as represented by 4×0.3=1.2 (see FIG. 5B). Hereinafter, the demanded flow rate in such a combined operation is denoted by the demanded flow rate Fin=(1.6, 1.2). Since this demanded flow rate Fin=(1.6, 1.2) falls within the range (including the boundary) of the distribution region 53 (see FIG. 9), the flow rate distribution section 32 outputs the demanded flow rate Fin as the distribution flow rate Fout as it is. First, the pump allocation computing section 33 temporarily allocates the hydraulic pumps to the hydraulic actuators, that is to the boom cylinder 4 and the arm cylinder 5, for the distribution flow rate Fin=(1.6, 1.2) in accordance with the priorities from the perspective of the hydraulic actuators using the priority connection table 33*a* (see FIG. 6). Since the distribution flow rate to the boom cylinder 4 is 1.6, two hydraulic pumps are demanded and the hydraulic pumps 10*a* and 10*b* (having the highest and second highest priorities from the perspective of the hydraulic actuator, that is, from the perspective of the boom cylinder 4) are temporarily allocated to the boom cylinder 4. Furthermore, since the distribution flow rate to the arm cylinder 5 is 1.2, two hydraulic pumps are demanded and the hydraulic pumps 10*d* and 10*a* (having the highest and second highest priorities from the perspective of the hydraulic actuator, that is, from the perspective of the arm cylinder 5) are temporarily allocated to the arm cylinder 5. Next, the pump allocation computing section 33 adjusts allocation based on the priorities from the perspective of the hydraulic pumps to determine the allocation flow rate=(1.6, 1), and the remaining distribution flow rate is updated as represented by the remaining distribution flow rate=(1.6, 1.2)−(1.6, 1)=(0, 0.2). Since all the values in the remaining distribution flow rate are not zero, the pump allocation computing section 33 temporarily allocates, as a remaining pump, the hydraulic pump 10*c* to the arm cylinder 5 for the remaining distribution flow rate. Since there is no redundant temporarily allocated hydraulic pump, the adjustment of the allocation based on the priorities from the perspective of the hydraulic pump 10*c* is unnecessary and the allocation is settled. The computation result is output as the control signals (pump commands) to the hydraulic pumps 10*a* to 10*d* and the control signals (valve commands) to the hydraulic valve groups 12*a* to 12*d*.

In another example, when the combined operation is performed such that the lever operation amount for the boom cylinder 4 is 35% and the lever operation amount for the arm cylinder 5 is 85% at certain time t1, then the demanded flow rate computing section 31 computes the demanded flow rate of the boom cylinder 4 as represented by 4×0.35=1.4 (see FIG. 5A), the demanded flow rate of the arm cylinder 5 as represented by 4×0.85=3.4 (see FIG. 5B), and determines a demanded flow rate Fin(t1)=(1.4, 3.4). Since this demanded flow rate Fin(t1)=(1.4, 3.4) is out of the range of the distribution region 53 (see FIG. 10), the flow rate distribution section 32 computes a line L(t1) that passes through the origin of the coordinate system and the demanded flow rate Fin(t1)=(1.4, 3.4). For example, when it is considered that the demanded flow rate of the arm cylinder 5 is the y-axis and the demanded flow rate of the boom cylinder 4 is the x-axis, the line L(t1) is represented as y=(3.4/1.4)x. Here, an intersecting point between the line L(t1) and the boundary of the distribution region 53, that is, a computation result is a distribution flow rate Fout(t1)=(1, 17/7) (see FIG. 10). First, the pump allocation computing section 33 temporarily allocates the hydraulic pumps to the hydraulic actuators for the distribution flow rate Fout(t1)=(1, 17/7) in accordance with the priorities from the perspective of the hydraulic actuators using the priority connection table 33*a* (see FIG. 6). Since the distribution flow rate to the boom cylinder 4 is (1), one hydraulic pump is demanded and the hydraulic pump 10*a* (having the highest priority from the perspective of the hydraulic actuator, that is, from the perspective of the boom cylinder 4) is temporarily allocated to the boom cylinder 4. Furthermore, since the distribution flow rate to the arm cylinder 5 is (17/7), three hydraulic pumps are demanded and the hydraulic pumps 10*d*, 10*a*, and 10*b* (having the highest, the second highest, and third highest priorities from the perspective of the hydraulic actuator, that is, from the perspective of the arm cylinder 5) are temporarily allocated to the arm cylinder 5. Next, the pump allocation computing section 33 adjusts allocation based on the priorities from the perspective of the hydraulic pumps to determine the allocation flow rate=(1, 2), and the remaining distribution flow rate is updated as represented by the remaining distribution flow rate=(1, 17/7)−(1, 2)=(0, 3/7). Since all the values in the remaining distribution flow rate are not zero, the pump allocation computing section 33 temporarily allocates, as a remaining pump, the hydraulic pump 10*c* to the arm cylinder 5 for the remaining distribution flow rate. Since there is no redundant allocated hydraulic pump, the adjustment of the allocation based on the priorities from the perspective of the hydraulic pump 10*c* is unnecessary and the allocation is settled. The computation result is output as the control signals (pump commands) to the hydraulic pumps 10*a* to 10*d* and the control signals (valve commands) to the hydraulic valve groups 12*a* to 12*d*.

In yet another example, when the combined operation is performed such that the lever operation amount for the boom cylinder 4 is 85% and the lever operation amount for the arm cylinder 5 is 32.5% at certain time t2, then the demanded flow rate computing section 31 computes the demanded flow rate of the boom cylinder 4 as represented by 4×0.85=3.4 (see FIG. 5A), the demanded flow rate of the arm cylinder 5 as represented by 4×0.325=1.3 (see FIG. 5B), and determines a demanded flow rate Fin(t2)=(3.4, 1.3). Since this demanded flow rate Fin(t2)=(3.4, 1.3) is out of the range of the distribution region 53 (see FIG. 10), the flow rate distribution section 32 computes a line L(t2) that passes through the origin of the coordinate system and the demanded flow rate Fin(t2)=(3.4, 1.3). For example, when it is considered that the demanded flow rate of the arm cylinder 5 is the y-axis and the demanded flow rate of the boom cylinder 4 is the x-axis, the line L(t2) is represented as y=(1.3/3.4)x. Here, an intersecting point between the line L(t2) and the boundary of the distribution region 53, that is, a computation result is a distribution flow rate Fout(t2)=(34/13, 1) (see FIG. 10). First, the pump allocation computing section 33 temporarily allocates the hydraulic pumps to the hydraulic actuators for the distribution flow rate Fout(t2)=(34/13, 1) in accordance with the priorities from the perspective of the hydraulic actuators using the priority connection table 33*a* (see FIG. 6). Since the distribution flow rate to the boom cylinder 4 is (34/13), three hydraulic pumps are demanded and the hydraulic pumps 10*a*, 10*b*, and 10*c* (having the highest, the second highest, and the third highest priorities from the perspective of the hydraulic actuator, that is, from the perspective of the boom cylinder 4) are temporarily allocated to the boom cylinder 4. Furthermore, since the distribution flow rate to the arm cylinder 5 is (1), one hydraulic pump is demanded and the hydraulic pump 10*d* (having the highest priority from the perspective of the hydraulic actuator, that is, from the perspective of the arm cylinder 5) is temporarily allocated to the arm cylinder 5. Since there is no redundant temporarily allocated hydraulic pump, the adjustment of the allocation based on the priorities from the perspective of the hydraulic pump 10*c* is unnecessary and the allocation is settled. The computation result is output as the control signals (pump commands) to the hydraulic pumps 10*a* to 10*d* and the control signals (valve commands) to the hydraulic valve groups 12*a* to 12*d*.

Figure 11:
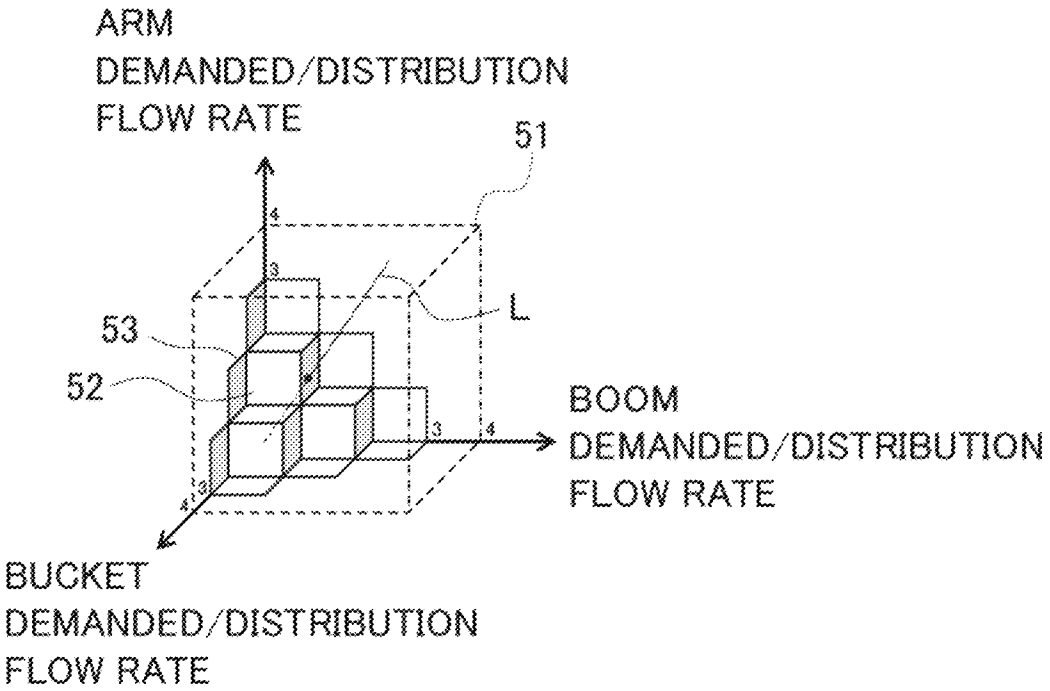
FIG. 11 is a conceptual explanatory diagram of the relationship between the demanded flow rate and the distribution flow rate in a combined operation of an arm cylinder, a boom cylinder, and a bucket cylinder.

While the relationship between the demanded flow rate and the distribution flow rate is conceptually described while exemplarily referring to the combined operation of the arm cylinder 5 and the boom cylinder 4 In FIGS. 9 and 10, the relationship can be similarly considered for a combined operation of the three hydraulic actuators. For example, FIG. 11 is a conceptual explanatory diagram of a relationship between the demanded flow rate and the distribution flow rate in the combined operation of the arm cylinder 5, the boom cylinder 4, and the bucket cylinder 6. That is, in the combined operation shown in FIG. 11, similarly to the case described with reference to FIG. 7, when the demanded flow rate Fin falls within the range (including the boundary) of the distribution region 53, the demanded flow rate Fin is used as the computation result of the distribution flow rate Fout (see Steps S100 and S101 of FIG. 7). When the demanded flow rate Fin is out of the range of the distribution region 53, the intersecting point between the line L passing through the origin of the coordinate system and the demanded flow rate Fin and the boundary of the distribution region 53 is used as the computation result of the distribution flow rate Fout. Moreover, the relationship between the demanded flow rate and the distribution flow rate can be considered similarly for a case of a combined operation of the four hydraulic actuators.

A series of processes by the flow rate distribution section 32 will now be described while referring to a generalized and specific example for the case in which the number of hydraulic actuators and the number of hydraulic pumps are equal to or greater than four. In the present embodiment, a case in which the number of hydraulic pumps that can supply the hydraulic fluids to the hydraulic actuators related to the combined operation is equal to the number of hydraulic actuators related to the combined operation will be described by way of example.

Figure 12:
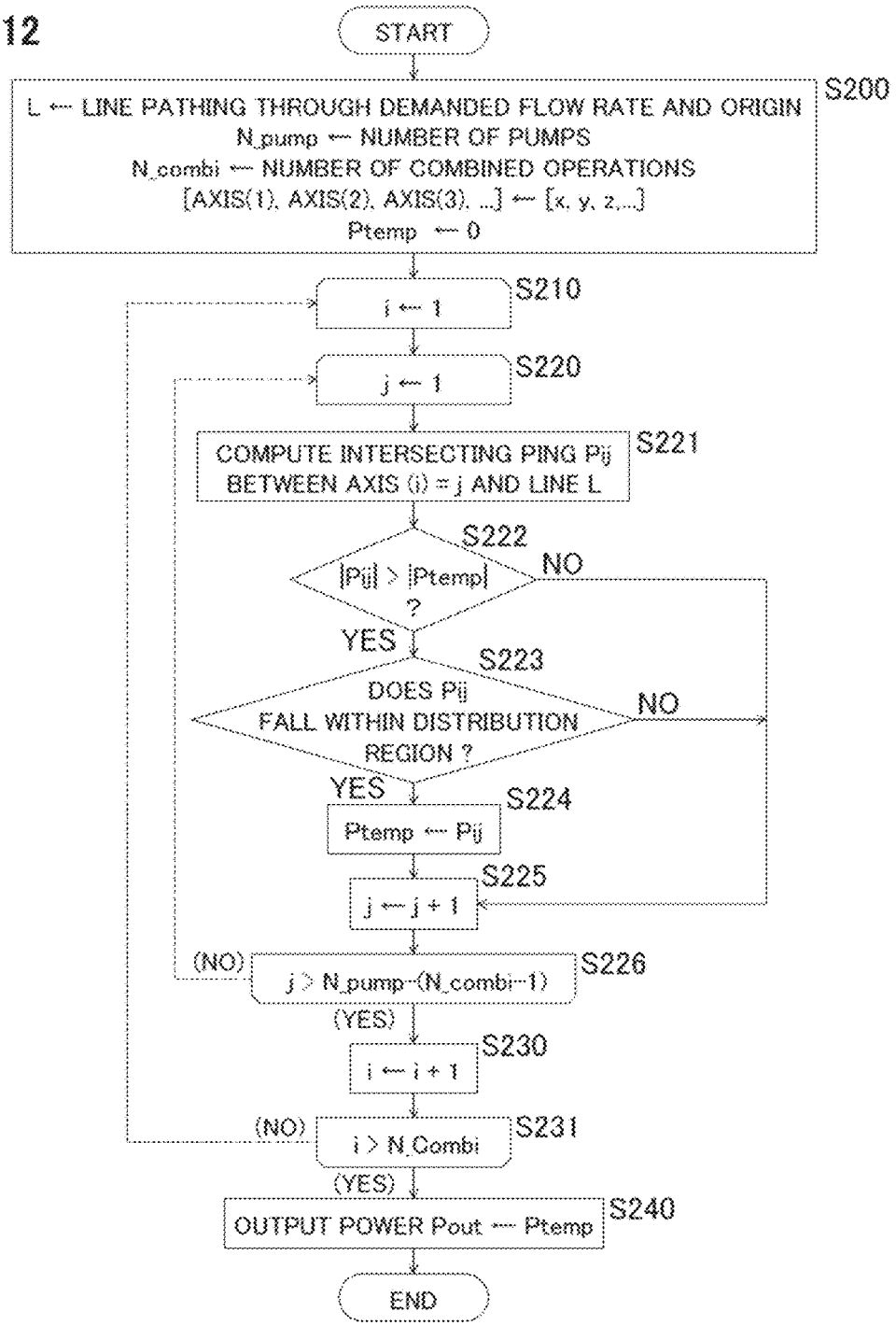
FIG. 12 is a flowchart showing processes by the flow rate distribution section.

FIG. 12 is a flowchart showing processes by the flow rate distribution section.

In FIG. 12, processes are shown for a generalized case in which the number of hydraulic pumps is N_pump and the number of combined operations of hydraulic actuators is N_combi and for a case in which the range of the distribution region is set equal to the range of the distributable region. The number of combined operations of the hydraulic actuators signifies the number of hydraulic actuators that can be operated simultaneously in the drive system to which the present invention is applied. That is, a case of the drive system for the hydraulic excavator according to the present embodiment as shown in FIG. 1 is a case in which N_pump=4 and N_combi=4. In the processes for the generalized case, the number of types of the lever operation amount input to the demanded flow rate computing section 31 and the number of relationships between the lever operation amount and the demanded flow rate used in the demanded flow rate computing section 31 are the same as the number of hydraulic actuators, and appropriately set in the manner of FIGS. 5A to 5D. The number of demanded flow rates computed by the demanded flow rate computing section 31 and output to the flow rate distribution section 32 is the same as the number of combined operations.

In FIG. 12, first, the flow rate distribution section 32 makes settings including a setting of coordinate axes of a coordinate system (hereinafter, referred to as "flow rate coordinate system") in which the distribution flow rate and the demanded flow rate per hydraulic actuator are set to each coordinate axis, a setting of the line L used in computation, a setting of an initial value of each variable, and the like (Step S200). In Step S200, the flow rate distribution section 32 sets (x, y, z, . . . ), in the flow rate coordinate system, to variables (axis (1), axis (2), axis (3), . . . ) specifying each coordinate axis corresponding to the demanded/distribution flow rates per actuator operating in combination, and sets the line passing through the demanded flow rate computed by the demanded flow rate computing section 31 and the origin as the line L. Furthermore, the flow rate distribution section 32 sets the number of hydraulic pumps to be controlled to the variable N_pump, and sets the number of combined operations to the variable N_combi. In addition, the flow rate distribution section 32 initially sets 0 (zero) to a variable Ptemp that represents a temporary output power value of the pumps in computation. Next, the flow rate distribution section 32 sets a variable of an integer as represented by i=1 (Step S210), and a set a variable of an integer j as represented by j=1 (Step S220). Next, the flow rate distribution section 32 computes an intersecting point Pij between the axis (i)=j and the line L (Step S221), and determines whether |Pij|>|Ptemp| is satisfied. That is, the flow rate distribution section 32 determines whether a total delivery amount of the pumps at the Pij is larger than a total delivery amount in the previous computation. Furthermore, the flow rate distribution section 32 determines whether the Pij falls within the range (including the boundary) of the distribution region 53 (Steps S222 and S223). In other words, the flow rate distribution section 32 determines whether a total number of pumps to be used does not exceed a total number of usable pumps even when the other pumps are used for the other actuator with the same ratio as the ratio among the demanded flow rates on the assumption that j pumps are used for the actuator corresponding to the axis (i). When determination results of Steps S222 and S223 are both YES, the flow rate distribution section 32 sets the Pij to Ptemp (Step S224) and then sets the variable j as represented by j=j+1 (Step S225). Furthermore, when any one of the determination results of Steps S222 and S223 is NO, the flow rate distribution section 32 sets the variable j as represented by j=j+1 (Step S225), and then determines whether j>N_pump−(N_combi−1) is satisfied (Step S226). Steps S220 to S226 configure a loop process. When a condition of Step S226 is satisfied (a determination result is NO), the flow rate distribution section 32 repeats the processes in Steps S221 to S225 until the condition in Step S226 is satisfied (until the determination result becomes YES).

When the condition of Step S226 is satisfied and the flow rate distribution section 32 exits the loop process (when the determination result is YES), the flow rate distribution section 32 sets the variable i as represented by i=i+1 (Step S230) and determines whether j>N_combi is satisfied (Step S231). Steps S220 to S231 configure a loop process containing the loop process in Steps S220 to S226 in a nested manner. When a condition of Step S231 is not satisfied (a determination result is NO), the flow rate distribution section 32 repeats the processes in Steps S220 to S230 until the condition of Step S231 is satisfied (until the determination result becomes YES). That is, the flow rate distribution section 32 calculates the delivery amount of each pump such that a sum of the delivery amounts of the pumps allocated to each actuator used in the combined operation is the largest, the ratio among the distribution flow rates is equal to the ratio among the demanded flow rates, and the delivery amount of each pump falls within the distributable region 52.

When the condition of Step S231 is satisfied and the flow rate distribution section 32 exits the loop process (the determination result is YES), the flow rate distribution section 32 sets the Ptemp to output power Pout (Step S240) and ends the processes. The output power Pout is output from the flow rate distribution section 32 as the distribution flow rate Fout.

Effects of the present embodiment configured as described so far will be described while comparing the present embodiment with the conventional technique.

Figure 20:
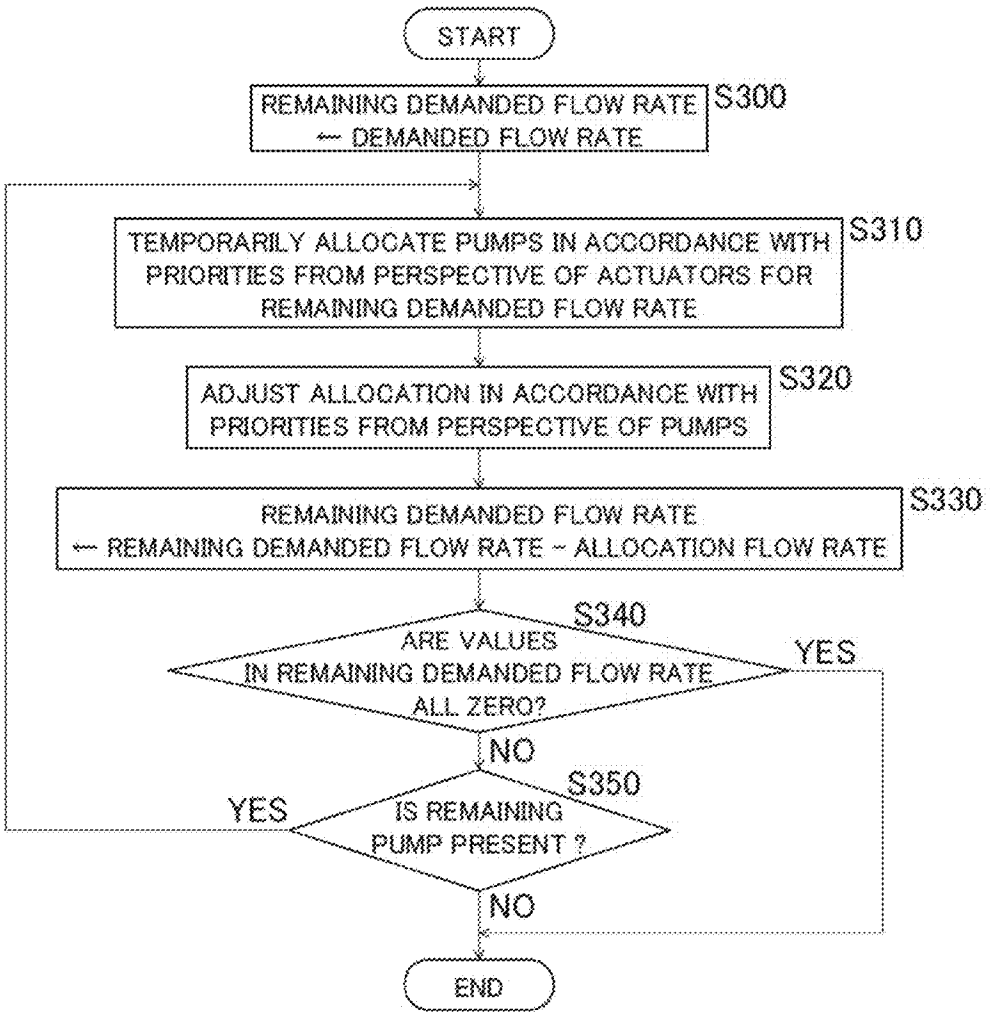
FIG. 20 is a flowchart of a flow rate distribution process and a pump allocation process shown as an example of a conventional technique.
Figure 21:
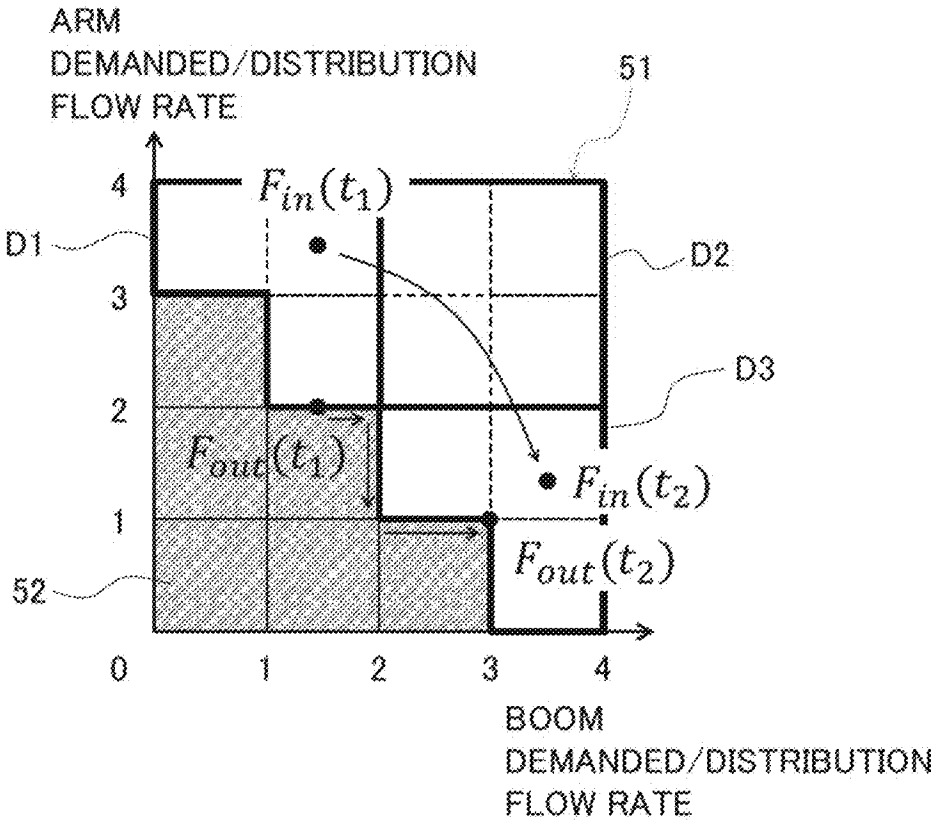
FIG. 21 is a conceptual explanatory diagram of the relationship between the demanded flow rate and the distribution flow rate according to the conventional technique.

FIG. 20 is a flowchart of a flow rate distribution process and a pump allocation process shown as an example of the conventional technique. In addition, FIG. 21 is a conceptual explanatory diagram of the relationship between the demanded flow rate and the distribution flow rate of the conventional technique, and shows a case of considering a combined operation of the arm cylinder and the boom cylinder by way of example. In the conventional technique, similarly to the present embodiment, the demanded flow rate=the distribution flow rate when the demanded flow rate falls within the range (including the boundary) of the distribution region. Therefore, FIG. 20 shows a case in which the demanded flow rate is out of the range of the distribution region. Moreover, in the conventional technique, similarly to the present embodiment, it is assumed that the priority connection table 33*a* shown in FIG. 6 according to the present embodiment is used.

In FIG. 20, first, the demanded flow rate is set to a remaining demanded flow rate in the conventional technique (Step S300). Next, the hydraulic pumps are temporarily allocated to the hydraulic actuators in accordance with the priorities from the perspective of the hydraulic actuators for the remaining demanded flow rate (Step S310), the allocation of the hydraulic pumps is then adjusted in accordance with the priorities from the perspective of the hydraulic pumps, and the redundantly allocated hydraulic pumps are allocated to the hydraulic actuator having a higher priority from the perspective of the hydraulic pumps (Step S320). Subsequently, the remaining demanded flow rate is updated to a flow rate obtained by removing the allocation flow rate (demanded flow rate for which the allocation of the hydraulic pumps is over) from the remaining demanded flow rate as a new remaining demanded flow rate (Step S330). Here, it is determined whether all values in the remaining demanded flow rate are zero (Step S340). When a determination result is YES, the process is ended. When the determination result of Step S340 is NO, it is determined whether remaining pumps (hydraulic pumps that are not determined to be allocated) are present (Step S350). When a determination result is NO, the process returns to the process in Step S310. When the determination result is YES, the process is ended.

Contents of the process according to the conventional technique will now be described specifically. For example, when the demanded flow rate Fin(t1)=(1.4, 3.4) at time t1, the distribution flow rate is computed as represented by Fout(t1)=(1.4, 2.0). Furthermore, when the demanded flow rate Fin(t2)=(3.4, 1.3) at time t2, the distribution flow rate is computed as represented by Fout(t2)=(3.0, 1.0). In FIG. 21, a region surrounded by points (0, 4), (0, 3), (1, 3), (1, 2), (2, 2), and (2, 4) is denoted by D1, a region surrounded by points (2, 4), (2, 2), (4, 2), and (4, 4) is denoted by D2, and a region surrounded by points (2, 2), (2, 1), (3, 1), (3, 0), (4, 0), and (4, 4) is denoted by D3. In this case, the demanded flow rate passes through the regions in order of D1, D2, and D3 when the demanded flow rate changes from Fin(t1) to Fin(t2).

Here, as shown in FIG. 21, when the demanded flow rate is in the region D1, the distribution flow rate to the boom cylinder changes but the distribution flow rate to the arm cylinder remains 2, that is, does not change. Furthermore, when the demanded flow rate is in the region D2, the distribution flow rates to the boom cylinder and the arm cylinder remain 2, that is, do not change. Moreover, when the demanded flow rate is in the region D3, the distribution flow rate to the boom cylinder often remains 3 and the distribution flow rate to the arm cylinder often remains 1, that is, both the distribution flow rates do not often change.

In this way, according to the conventional technique, when the plurality of hydraulic actuators are operated simultaneously, the hydraulic pumps in number that enables the supply of the necessary flow rate to each hydraulic actuator are not always connected to the hydraulic actuator depending on an operation situation. Owing to this, even if the operation device is operated in a state in which the necessary flow rate of a certain hydraulic actuator exceeds a maximum delivery amount preset to each of the hydraulic pumps connected to the hydraulic actuator, a supply flow rate to the hydraulic actuator does not change to follow the necessary flow rate.

Furthermore, when attention is paid to the demanded flow rate at the time t1, the demanded flow rate Fin(t1)=(1.4, 3.4) and the ratio between the demanded flow rate of the boom cylinder and that of the arm cylinder is, therefore, 1.4/3.4≈0.4. On the other hand, when attention is paid to the distribution flow rate at the time t1, the distribution flow rate Fout(t1)=(1.4, 2.0) and the ratio between the demanded flow rate of the boom cylinder and that of the arm cylinder is, therefore, 1.4/2.0=0.7. In this way, the ratio among the demanded flow rates of the hydraulic actuators greatly differs from the ratio among the distribution flow rates thereof, resulting in great deterioration of the operability by the operator.

In this way, a problem occurs that an operating speed of each hydraulic actuator and a change of the operating speed do not necessarily match the intention of the operator and operability by the operator disadvantageously decreases.

According to the present embodiment, by contrast, the controller 27 is configured to include: the demanded flow rate computing section 31 that computes the demanded flow rates Fin of the plurality of hydraulic actuators 4 to 7 in response to the operation amounts of the operation levers L1 and L2; the flow rate distribution section 32 that computes the distribution flow rates Fout such that the ratio among the distribution flow rates Fout of the plurality of hydraulic actuators 4 to 7 is equal to the ratio among the demanded flow rates Fin even when the demanded flow rates of the plurality of hydraulic actuators 4 to 7 are out of the range of the distributable region 52 when the distributable region 52 is set, which region is specified based on the distributable flow rates that are flow rates of the hydraulic fluids suppliable to the hydraulic actuators 4 to 7 from the plurality of hydraulic pumps 10*a* to 10*d*; and the pump allocation computing section 33 that computes the delivery flow rates of the plurality of hydraulic pumps 10*a* to 10*d* in response to the distribution flow rates Fout. Therefore, it is possible to appropriately control the distribution flow rate to each hydraulic actuator and to improve the operability by the operator.

That is, since each distribution flow rate is computed such that the ratio among the distribution flow rates to the plurality of hydraulic actuators is equal to the ratio among the demanded flow rates thereof, it is possible to operate the hydraulic actuators without disturbing a speed balance among the hydraulic actuators and to improve the operability by the operator.

Second Embodiment

A second embodiment of the present invention will be described with reference to FIGS. 13 to 16. In the drawings, similar members to those in the first embodiment are denoted by the same reference symbols and description thereof will be omitted.

The present embodiment describes a case in which a scaling process is performed on the distribution flow rate computed by the ratio distribution section 42.

Figure 13:
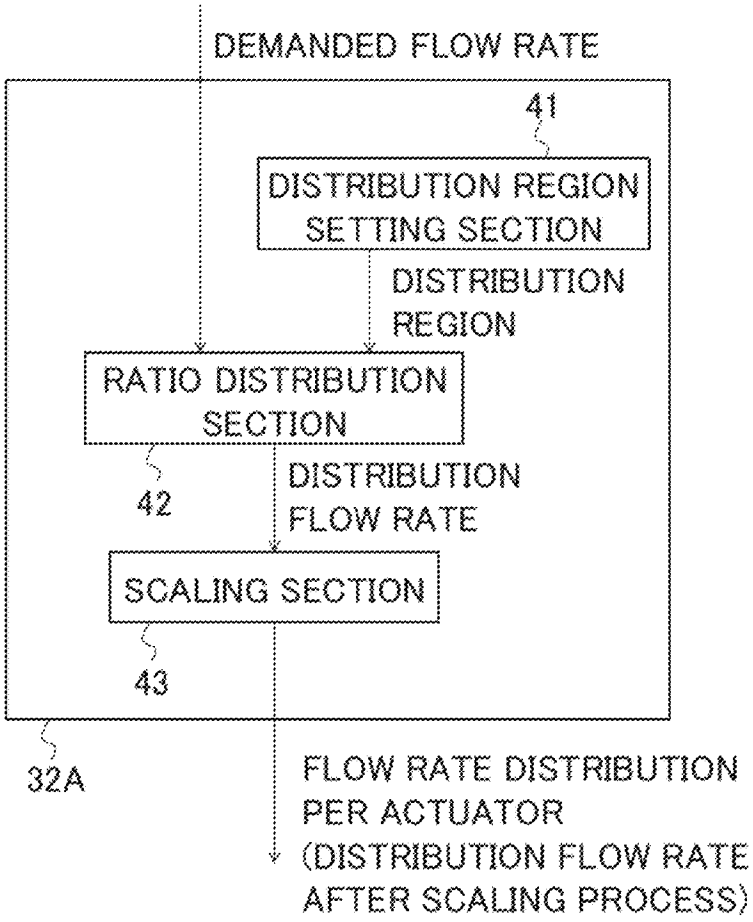
FIG. 13 is a functional block diagram showing processing functions of a flow rate distribution section according to a second embodiment.
Figure 14:
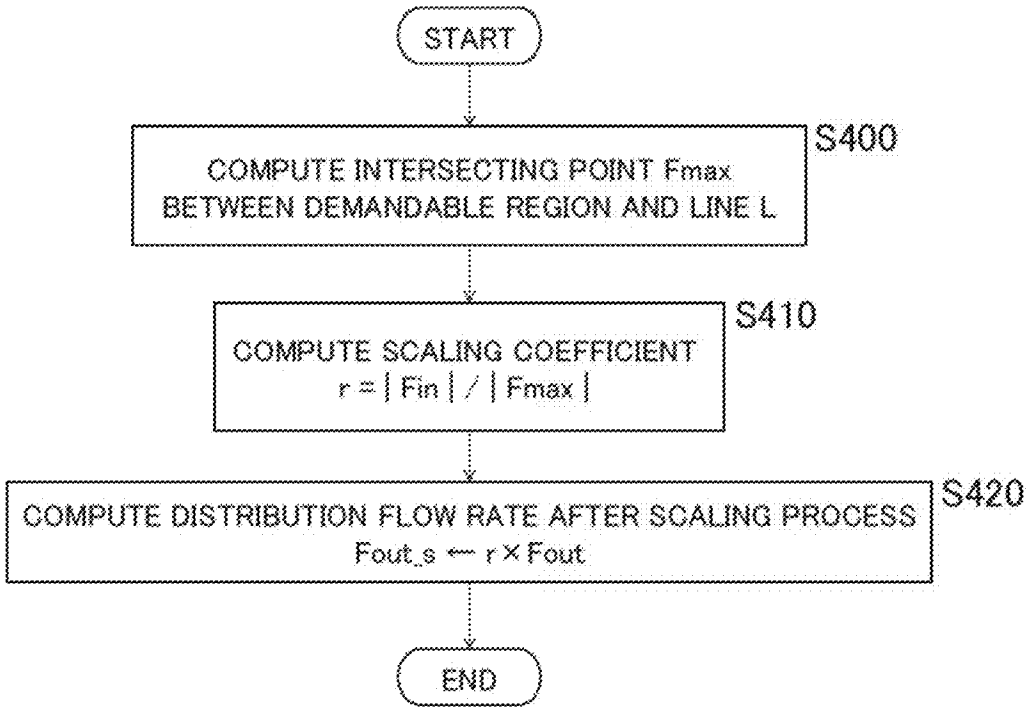
FIG. 14 is a flowchart showing a scaling process by a scaling section.
Figure 15:
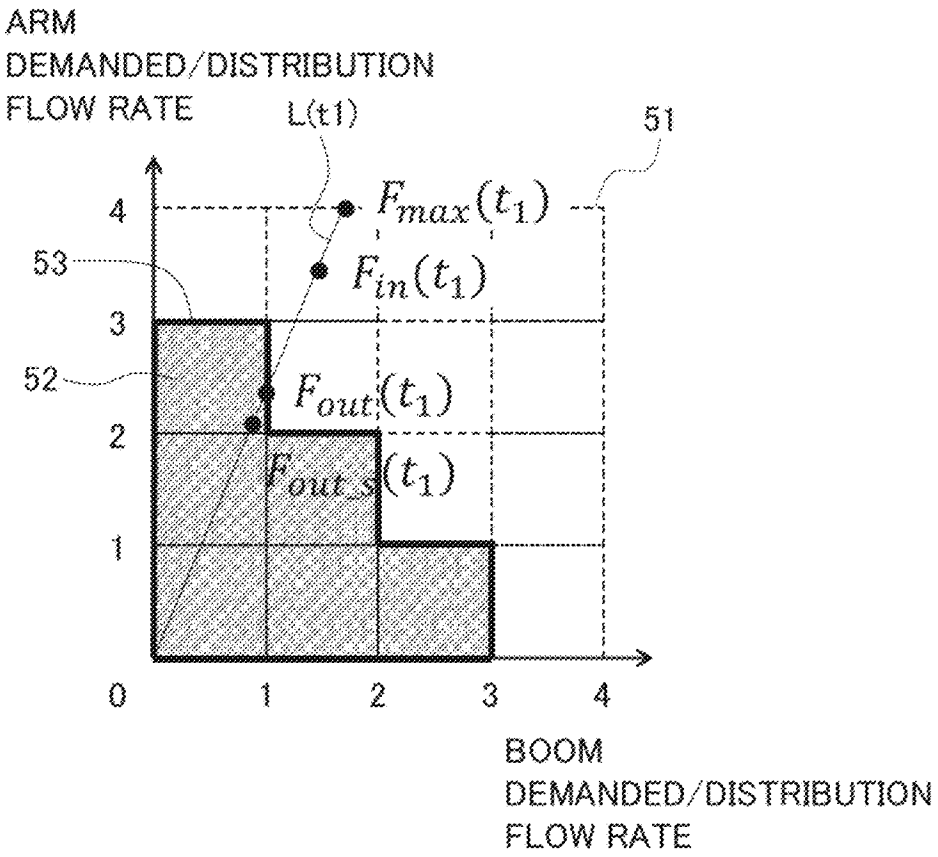
FIG. 15 is a conceptual explanatory diagram of the relationship between the demanded flow rate and the distribution flow rate.
Figure 16:
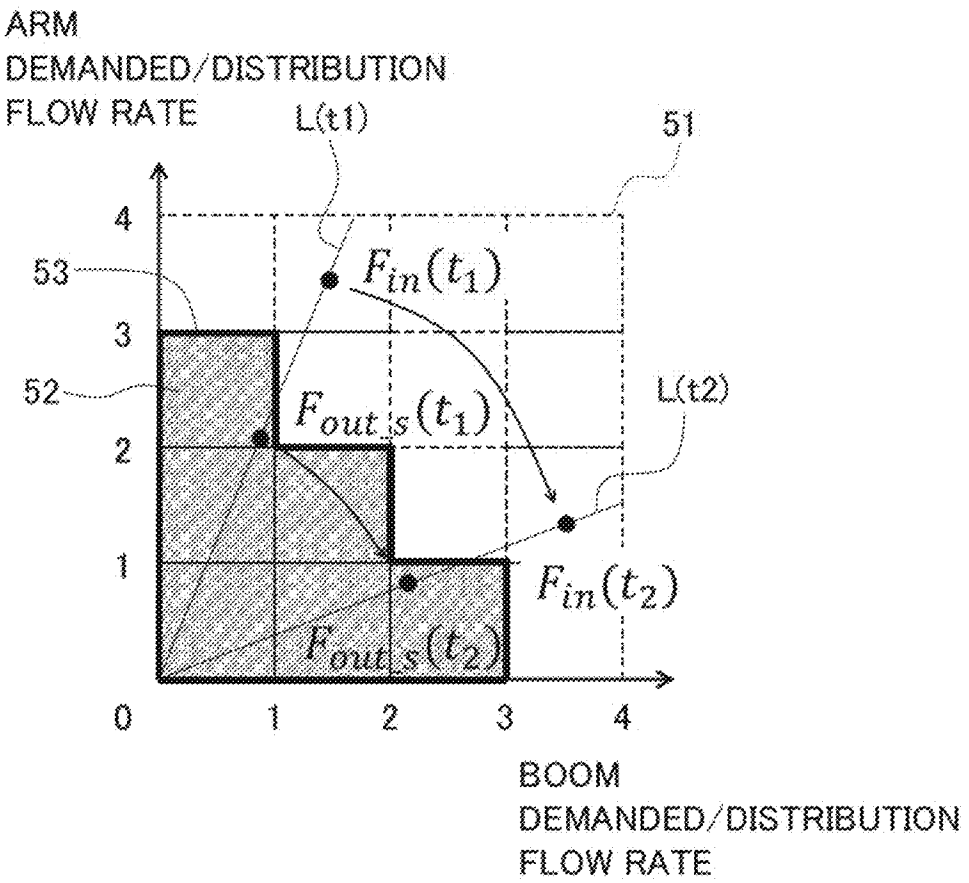
FIG. 16 is a conceptual explanatory diagram of the relationship between the demanded flow rate and the distribution flow rate.

FIG. 13 is a functional block diagram showing processing functions of a flow rate distribution section according to the present embodiment, and FIG. 14 is a flowchart showing the scaling process by a scaling section. In addition, FIGS. 15 and 16 are conceptual explanatory diagrams of the relationship between the demanded flow rate and the distribution flow rate, and show a case of considering the combined operation of the arm cylinder 5 and the boom cylinder 4 by way of example. FIG. 15 shows a state of the scaling process when the value of the demanded flow rate is out of the range of the distribution region 53, and FIG. 16 shows a state of the scaling process when the demanded flow rate and the distribution flow rate change.

In FIG. 13, a flow rate distribution section 32A includes: the distribution region setting section 41 that sets the distributable region 52 for computing the range of distributable flow rates that are flow rates of the hydraulic fluids suppliable to at least two hydraulic actuators (for example, the boom cylinder 4 and the arm cylinder 5) driven by a combined operation among the plurality of hydraulic actuators 4 to 7 from the plurality of hydraulic pumps 10*a* to 10*d* for the at least two hydraulic actuators, and that sets the distribution region 53 within the distributable region 52 for computing the distribution flow rates of the hydraulic fluids supplied to the at least two hydraulic actuators; the ratio distribution section 42 that computes the distribution flow rates in such a manner that the distribution flow rates fall within the distribution region 53 and the ratio between the distribution flow rates to the at least two hydraulic actuators is equal to the ratio between the demanded flow rates of the at least two hydraulic actuators when at least the demanded flow rate is out of the range of the distributable region 52; and a scaling section 43 that sets a ratio between the demanded flow rate and the distribution flow rate such that the distribution flow rate increases or decreases as the demanded flow rate increases or decreases and that reduces (performs a scaling process on) the distribution flow rate computed by the ratio distribution section 42 on the basis of this ratio.

In FIG. 14, first, the scaling section 43 computes an intersecting point Fmax between the line L passing through the origin of the flow rate coordinate system and the demanded flow rate Fin and a boundary of the demandable region 51 (Step S400). Next, the scaling section 43 computes a scaling coefficient r=|Fin|/|Fmax| that is a ratio between a magnitude of the demanded flow rate Fin and a magnitude of the Fmax (Step S410). The scaling section 43 then computes a new distribution flow rate Fout_s (distribution flow rate after the scaling process) by multiplying the distribution flow rate Fout computed by the ratio distribution section 42 by the scaling coefficient r (Step 420).

Contents of the scaling process by the scaling section 43 will now be described specifically.

As shown in FIGS. 15 and 16, for example, when the demanded flow rate is Fin(t1)=(1.4, 3.4) at the time t1, the scaling section 43 computes the line L(t1) passing through the origin of the flow rate coordinate system and the demanded flow rate Fin(t1)=(1.4, 3.4). When it is assumed that the demanded flow rate related to the boom cylinder 4 is x and the demanded flow rate related to the arm cylinder 5 is y, the line L(t1) is represented as y=(3.4/1.4)x. Next, the scaling section 43 computes a scaling coefficient r(t1)=|Fin(t1)|/|Fmax(t1)|=17/20 using an intersecting point Fmax(t1)=(28/17, 4) between the line L(t1) and the boundary of the demandable region 51. The scaling section 43 computes Fout_s(t1)=(17/20, 289/140) using the distribution flow rate Fout(t1) computed by the ratio distribution section 42 and the scaling coefficient r(t1).

The other configurations are similar to those in the first embodiment.

The present embodiment configured as described above can obtain similar effects to those of the first embodiment.

Furthermore, performing the scaling process as described in the present embodiment enables the distribution flow rate Fout_s after the scaling process to always increase or decrease as the demanded flow rate Fin increases or decreases. Moreover, as shown in FIG. 16, the distribution flow rate changes from Fout_s(t1) to Fout_s(t2) as the demanded flow rate changes from Fin(t1) to Fin(t2). Therefore, it is possible to eliminate a dead zone in which the distribution flow rate does not change with a change of the demanded flow rate and to greatly improve the operability.

Modification of Second Embodiment

A modification of the second embodiment according to the present invention will be described with reference to FIGS. 17 and 18. In the drawings, similar members to those in the first and second embodiments are denoted by the same reference symbols and description thereof will be omitted.

In the present modification, the flow rate distribution section 32A is configured in such a manner that the distribution region setting section 41 sets a distribution region 54 such that a maximum value that is a sum of the distribution flow rates set to the plurality of hydraulic actuators 4 to 7 within a range of a distribution region is constant irrespective of the ratio among the demanded flow rates of the plurality of hydraulic actuators 4 to 7 as an alternative to the distribution region 53 set in the same range as that of the distributable region 52 in the second embodiment. Furthermore, the flow rate distribution section 32A is configured in such a manner that the scaling section 43 performs the scaling process. A series of processes by the flow rate distribution section 32A will now be described while referring to a generalized and specific example for the case in which the number of hydraulic actuators and the number of hydraulic pumps are equal to or greater than four. Similarly to the preceding embodiments, the distribution region 54 set in the present modification is set to fall within the range of the distributable region 52.

Figure 17:
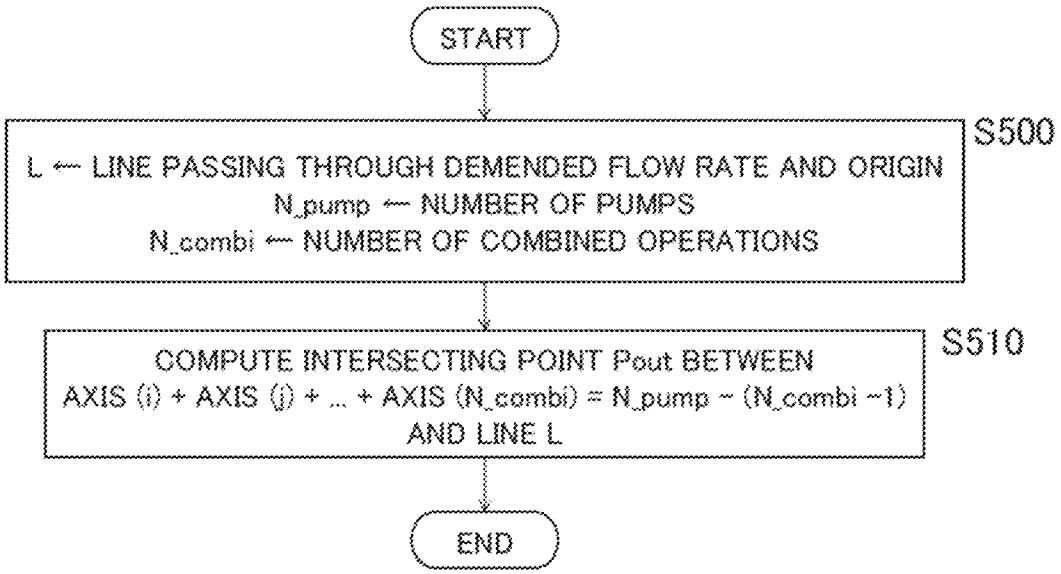
FIG. 17 is a flowchart showing processes by the flow rate distribution section according to a modification of the second embodiment.

FIG. 17 is a flowchart showing processes by the flow rate distribution section. In addition, FIG. 18 is a conceptual explanatory diagram of the relationship between the demanded flow rate and the distribution flow rate, and shows a case of considering the combined operation of the arm cylinder 5 and the boom cylinder 4 by way of example. In the present modification, similarly to the first embodiment, the demanded flow rate=the distribution flow rate when the demanded flow rate falls within the range (including the boundary) of the distribution region 54. Therefore, FIG. 18 shows a case in which the demanded flow rate is out of the range of the distribution region 54.

In FIG. 17, processes are shown for a generalized case in which the number of hydraulic pumps is N_pump and the number of combined operations of hydraulic actuators is N_combi. The number of combined operations of the hydraulic actuators signifies the number of hydraulic actuators that can be operated simultaneously in the drive system to which the present invention is applied. That is, a case according to the present modification is a case in which N_pump=4 and N_combi=4.

In FIG. 17, first, the ratio distribution section 42 (see FIG. 13) in the present modification sets the line L passing through the origin of the flow rate coordinate system and the demanded flow rate Fin computed by the demanded flow rate computing section 31 (see FIG. 4), sets the number of hydraulic pumps to be controlled to the variable N_pump, and sets the number of combined operations to the variable N_combi (Step S500). Next, the scaling section 43 computes an intersecting point Pout between a function: axis (i)+axis (j)+ . . . +axis (N_combi)=Npump−(Ncombi−1) corresponding to a boundary of the distribution region 54 (see FIG. 18) in the present modification set by the distribution region setting section 41 (see FIG. 13) and the line L (Step S510), and the processes are ended.

Through the above processes, it is possible to obtain a computation result of the distribution flow rate Fout (output power Pout) for the generalized case in which the number of hydraulic pumps is N_pump and the number of combined operations of hydraulic actuators is N_combi, in the distribution region 54 set in the present modification. Furthermore, the scaling section 43 performs the scaling process on the obtained distribution flow rate Fout, and outputs the distribution flow rate after the scaling process Fout_s to the pump allocation computing section 33.

Contents of the processes by the ratio distribution section 42 and the scaling section 43 will now be described specifically.

Figure 18:
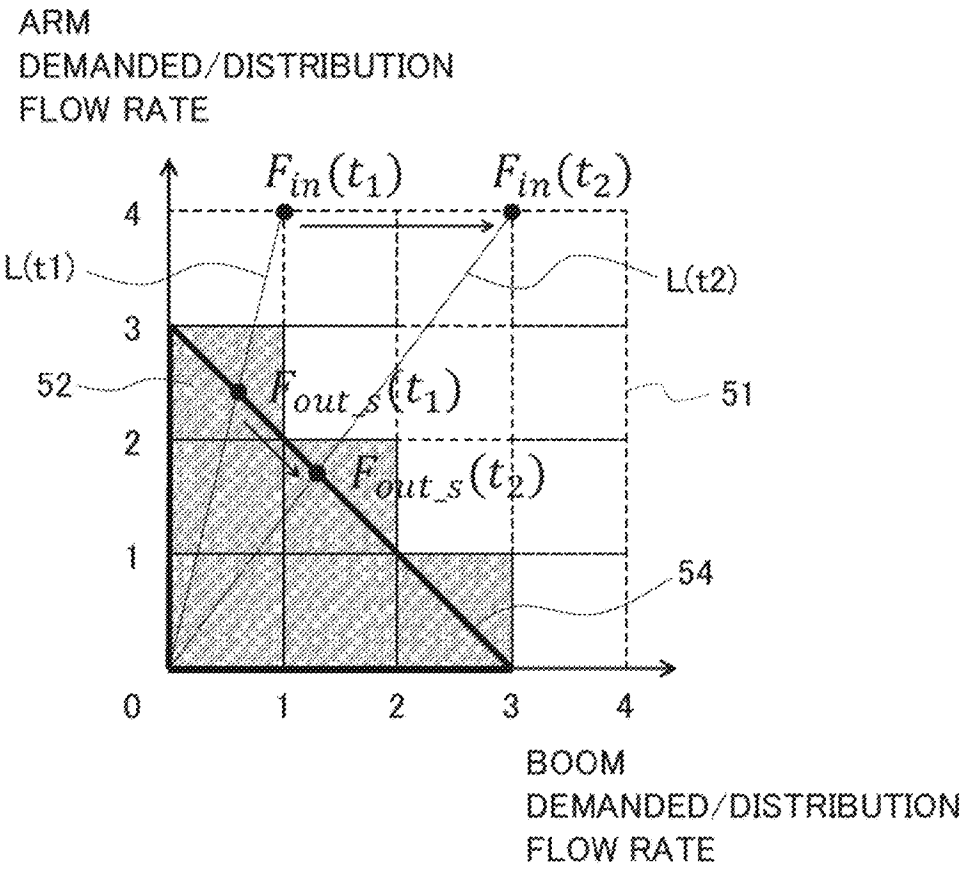
FIG. 18 is a conceptual explanatory diagram of the relationship between the demanded flow rate and the distribution flow rate.

For example, as shown in FIG. 18, a case in which a triangular region surrounded by lines connecting points (0, 0), (3, 0), and (0, 3) is set to the distribution region 54, and the demanded flow rate changes from Fin(t1)=(1, 4) to Fin(t2)=(3, 4) is considered. The line L(t1) passing through the origin of the flow rate coordinate system and the demanded flow rate Fin(t1)=(1, 4) at the time t1 is computed. When it is assumed that the demanded flow rate related to the boom cylinder 4 is x and the demanded flow rate related to the arm cylinder 5 is y, the line L(t1) is represented as y=4x. Here, an intersecting point between the line L(t1) and the distribution region 54 is Fout(t1)=(3/5, 12/5). Next, the scaling section 43 computes the scaling coefficient r(t1) =|Fin(t1)|/|Fmax(t1)|=1 using the intersecting point Fmax (t1)=Fin(t1)=(1, 4) between the line L(t1) and the demandable region 51. The scaling section 43 then computes Fout_s(t1)=(3/5, 12/5) using the distribution flow rate Fout (t1) computed by the ratio distribution section 42 and the scaling coefficient r(t1).

Furthermore, the distribution flow rate Fout(t2)=(9/7, 12/7) at time t2. The scaling section 43 computes Fout_s (t2)=(9/7, 12/7) using the distribution flow rate Fout(t2) computed by the ratio distribution section 42 and the scaling coefficient r(t2)=1.

The other configurations are similar to those in the second embodiment.

The present modification configured as described above can obtain similar effects to those of the first and second embodiments.

Moreover, by performing the processes as described in the present modification, a sum of the distribution flow rate to the boom cylinder 4 and the distribution flow rate to the arm cylinder 5 for the distribution flow rate Fout_s(t1) is 3/5+12/5=3, and a sum of the distribution flow rate to the boom cylinder 4 and the distribution flow rate to the arm cylinder 5 for the distribution flow rate Fout_s(t2) is 9/7+12/7=3, that is, equal to the former sum, as described with reference to FIG. 18. Therefore, it is possible to obtain an operational feeling that a certain flow rate is always shared between the boom cylinder 4 and the arm cylinder 5.

Modification of First Embodiment

A modification of the first embodiment according to the present invention will be described with reference to FIG. 19. In the drawings, similar members to those in the first and second embodiments are denoted by the same reference symbols and description thereof will be omitted.

In the present modification, the distribution region setting section 41 sets a distribution region 55 in a range in which the speed of the arm cylinder 5 tends to decrease when the lever operation amount related to the boom cylinder 4 is equal to or larger than a preset constant value, as an alternative to the distribution region 53 set in the same range as that of the distributable region 52. Similarly to the first embodiment, the distribution region 55 set in the present modification is set to fall within the range of the distributable region 52.

Figure 19:
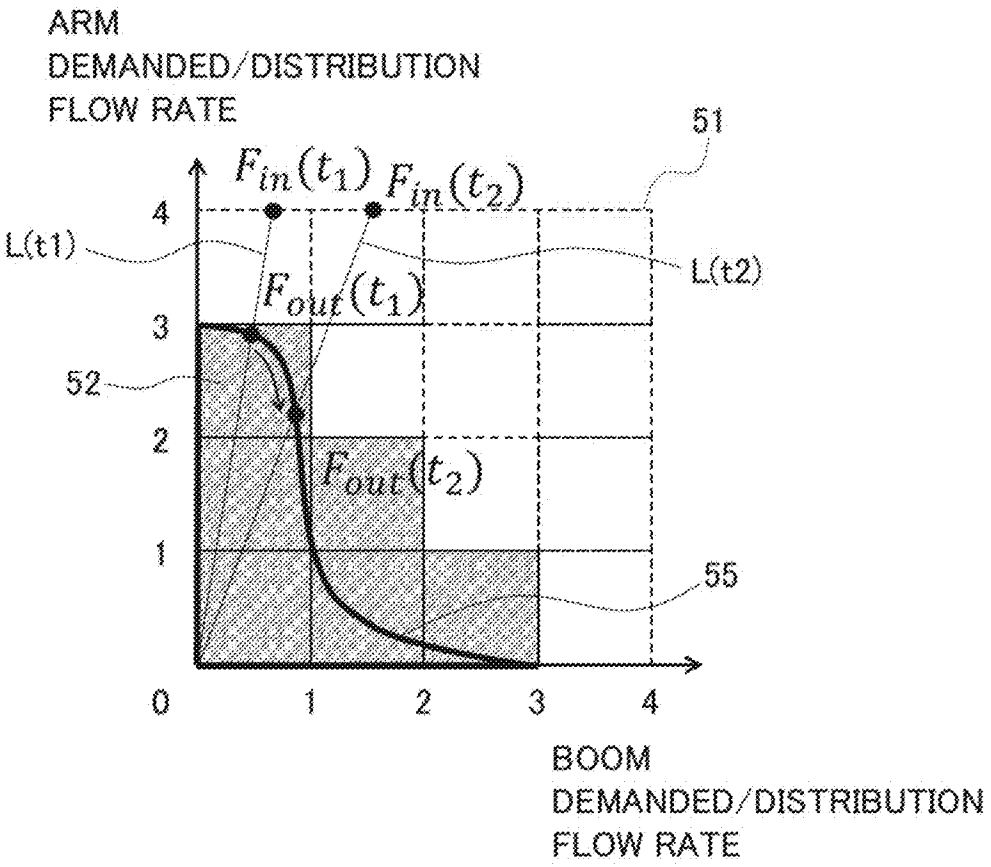
FIG. 19 is a conceptual explanatory diagram of the relationship between the demanded flow rate and the distribution flow rate according to a modification of the first embodiment.

FIG. 19 is a conceptual explanatory diagram of the relationship between the demanded flow rate and the distribution flow rate in the present modification, and shows a case of considering the combined operation of the arm cylinder 5 and the boom cylinder 4 by way of example.

As shown in FIG. 19, the distribution region 55 is set such that when the demanded flow rate (or distribution flow rate) related to the boom cylinder 4 is close to 0 (that is, when the operation levers L1 and L2 related to the boom cylinder 4 is a fine operation: at the time t1), a value of the distribution flow rate Fout(t1) related to the arm cylinder 5 is close to the boundary of the distributable region 52 (that is, close to a maximum value of the distribution flow rate specified by the distributable region 52). In addition, the distributable region 55 is set such that after the fine operation of the operation levers L1 and L2 related to the boom cylinder 4 (for example, time t1→t2), the distribution flow rate Fout(t2) is away from the boundary of the distributable region 52, that is, the speed (distribution flow rate) of the arm cylinder 5 tends to decrease as the demanded flow rate (or distribution flow rate) related to the boom cylinder 4 increases.

The other configurations are similar to those in the first embodiment.

The present modification configured as described above can obtain similar effects to those of the first embodiment.

Furthermore, for example, when the operation of the operation levers L1 and L2 related to the boom cylinder 4 and the arm cylinder 5 is considered as described in the present modification, the distribution region 55 can be set such that after the fine operation of the operation levers L1 and L2 related to the boom cylinder 4, the declining rate of the speed (distribution flow rate) of the arm cylinder 5 increases (that is, the speed tends to decrease) as the demanded flow rate (or distribution flow rate) of the boom cylinder 4 increases. In this case, it is possible to obtain the operational feeling that when the operation of the operation levers L1 and L2 related to the boom cylinder 4 is started, the speed of the arm cylinder 5 decreases with an increase of the lever operation amount, that is, the operational feeling suited for work for suppressing driving of the arm cylinder 5 while preferentially driving the boom cylinder 4.

Features of the above embodiments will next be described.

(1) According to the above embodiments, a drive system for a construction machine includes: a plurality of hydraulic actuators (for example, a boom cylinder 4, an arm cylinder 5, a bucket cylinder 6, and a swing motor 7); a plurality of pump devices (for example, hydraulic pumps 10*a* to 10*d*) connected to the plurality of hydraulic actuators 4 to 7 via a plurality of hydraulic lines, and delivering hydraulic fluids in response to an operation amount of an operation device (for example, operation levers L1 and L2); a plurality of hydraulic valves (for example, hydraulic valve groups 12*a* to 12*d*) provided in the plurality of hydraulic lines, and changing over flows of the plurality of hydraulic lines in such a manner that the hydraulic fluids delivered from the plurality of pump devices are selectively supplied to the plurality of hydraulic actuators; and a controller 27 that controls the pump devices and the hydraulic valves in response to the operation amount of the operation device. The controller includes: a demanded flow rate computing section 31 that computes a demanded flow rate of each of the plurality of hydraulic actuators in response to the operation amount of the operation device; a flow rate distribution section 32 that computes a distribution flow rate of the hydraulic fluid supplied to each of the plurality of hydraulic actuators on the basis of the demanded flow rate; and a pump allocation computing section 33 that computes a delivery flow rate of each of the plurality of pump devices in response to the distribution flow rate. The flow rate distribution section includes: a distribution region setting section 41 that sets a distributable region 52 for computing a range of a distributable flow rate that is a flow rate of the hydraulic fluid suppliable to each of at least two hydraulic actuators driven by a combined operation among the plurality of hydraulic actuators from the plurality of hydraulic pump devices for the at least two hydraulic actuators, and that sets a distribution region 53 within the distributable region for computing a range of the distribution flow rate of the hydraulic fluid actually supplied to each of the at least two hydraulic actuators; and a ratio distribution section 42 that computes the distribution flow rate in such a manner that when at least the demanded flow rate is out of the distributable region, the distribution flow rate falls within the distribution region and a ratio between the distribution flow rates of the at least two hydraulic actuators is equal to a ratio between the demanded flow rates of the at least two hydraulic actuators.

By making the ratio among the distribution flow rates of the hydraulic actuators equal to the ratio among the demanded flow rates thereof, it is possible to drive the hydraulic actuators while always keeping a speed balance intended by an operator.

(2) Furthermore, according to the above embodiments, in the drive system for a construction machine according to (1), the distribution region setting section sets a range of the distribution region equal to a range of the distributable region.

By setting the distribution region as a region equal to the distributable region, it is possible to make a sum of the distribution flow rates as large as possible, and to drive the hydraulic actuators with the speed balance intended by the operator kept while gaining the speed of the hydraulic actuators.

(3) Moreover, according to the above embodiments, in the drive system for a construction machine according to (1), the distribution region setting section sets the distribution region in such a manner that a maximum value of a sum of the distribution flow rates set to the at least two hydraulic actuators within a range of the distribution region is constant irrespective of the ratio between the demanded flow rates of the at least two hydraulic actuators.

By setting the distribution region to the region in which the maximum value of the sum of the distribution flow rates set to the hydraulic actuators is constant, an upper limit value of the sum of the distribution flow rates becomes a constant value. Therefore, it is possible to drive the hydraulic actuators with the speed balance intended by the operator kept while obtaining a flow-diverting operational feeling that a specific flow rate is shared among the hydraulic actuators.

(4) Furthermore, according to the above embodiments, in the drive system for a construction machine according to (1), the distribution region setting section sets the distribution region in such a manner that as the demanded flow rate of one of the at least two hydraulic actuators increases from a value indicating a fine operation, a declining rate of the distribution flow rate of at least one hydraulic actuator other than the one hydraulic actuator increases.

For example, when an operation of the operation levers related to the boom cylinder and the arm cylinder is considered, it is possible to set the distribution region in such a manner that after the fine operation of the operation levers related to the boom cylinder, the speed (distribution flow rate) of the arm cylinder tends to decrease (the declining rate of the speed of the arm cylinder increases) as the demanded flow rate (or the distribution flow rate) related to the boom cylinder increases. In this case, it is possible to obtain an operational feeling that when the operation of the operation levers related to the boom cylinder is started, the speed of the arm cylinder decreases with an increase of the lever operation amount, that is, the operational feeling suited for work for suppressing driving of the arm cylinder while preferentially driving the boom cylinder.

(5) Moreover, according to the above embodiments, in the drive system for a construction machine according to (1), the flow rate distribution section further includes a scaling section that sets a ratio between the demanded flow rate and the distribution flow rate in such a manner that the distribution flow rate increases or decreases as the demanded flow rate increases or decreases, and that reduces the distribution flow rate computed by the ratio distribution section on the basis of the ratio.

By making the distribution region and the demandable region correspond to each other in 1-to-1 correspondence, it is possible to increase the distribution flow rate as the demanded flow rate increases and to reduce the distribution flow rate as the demanded flow rate decreases. Therefore, it is possible to change the distribution flow rate to follow a change of the demanded flow rate while keeping the speed balance intended by the operator.

<Note>

Computation is conducted with the scaling coefficient as represented by $r=|Fin|/|Fmax|$ in the above embodiments. However, the present invention is not limited to this scaling coefficient. If a scaling function r(Fin, Fmax) specified by variables Fin and Fmax satisfies $0 \leq r(Fin, Fmax) \leq 1$, it is possible to arbitrarily set the scaling coefficient (scaling function) r. For example, it is possible to set the scaling function as represented by $r=(|Fin|/|Fmax|)^2$. If the scaling function is set in this way, it is possible to obtain an operational feeling that when the lever operation amounts related to the boom cylinder and the arm cylinder are increased with the ratio kept constant in the two-combined operation of the boom cylinder and the arm cylinder, the speed increases at an increasing rate as the operation is closer to the latter half.

Furthermore, while a case of using the priority connection table for the pump allocation process has been exemplarily described, the present invention is not limited to this case. For example, the pump allocation process may be configured to allocate the hydraulic pumps by appropriately selecting non-allocated hydraulic pumps.

Moreover, while a case in which the intersecting point between the boundary of the demandable region and the line L is Fmax in the scaling process has been exemplarily described, the present invention is not limited to this case. It may be considered that the scaling process is performed while defining an intersecting point between a region other than the boundary of the demandable region and the line L as Fmax. For example, an intersecting point between y=3 (that is, the arm cylinder demanded flow rate=3) and the line L is defined as Fmax in FIG. 15. In this case, it is possible to configure the drive system such that the distribution flow rate follows a change of the demanded flow rate of the arm cylinder in a region where the demanded flow rate of the arm cylinder is equal to or smaller than 3, but that the distribution flow rate does not follow the change of the demanded flow rate of the arm cylinder in a region where the demanded flow rate of the arm cylinder is greater than 3. This means that the demanded flow rate at which the distribution flow rate saturates (is saturated) can be set independently of a case of independently operating the hydraulic actuators.

Furthermore, a case of applying the present invention to a hydraulic circuit system using closed-circuit pumps as a drive system for the hydraulic excavator has been exemplarily described in the above embodiments. However, the present invention is not limited to the case. The present invention can be also applied to a hydraulic circuit system using open-circuit pumps that are one-side tilting pumps, directional control valves for controlling a direction of driving the hydraulic actuators, and the like.

Moreover, a case in which the number of the plurality of hydraulic pumps is equal to the number of the plurality of hydraulic actuators has been exemplarily described in the above embodiments. However, the present invention is not limited to this case. The present invention can be applied even to a case in which the number of the hydraulic pumps to be used is equal to or greater than the number of the plurality of hydraulic actuators by configuring the drive system such that the number of the hydraulic pumps supplying the hydraulic fluids to the hydraulic actuators is appropriately adjusted to be equal to the number of the hydraulic actuators.

Furthermore, the ordinary hybrid excavator that drives the hydraulic pumps by the prime mover such as the engine has been described in the embodiments by way of example. Needless to say, the present invention can be applied to a hybrid hydraulic excavator that drives hydraulic pumps by an engine and a motor, a motorized hydraulic excavator that drives hydraulic pumps only by a motor, or the other hydraulic excavator.

Moreover, the present invention is not limited to the above embodiments but encompasses various modifications and combinations without departing from the spirit of the invention. For example, the distribution region described in the modification of the second embodiment can be set as the distribution region in the first embodiment, or the distribution region described in the modification of the first embodiment can be set as the distribution region in the second embodiment. Furthermore, the present invention is not limited to the drive system for a construction machine that includes all the configurations described in the above embodiments but encompasses those from which a part of the configurations is deleted.

What is claimed is:

1. A drive system for a construction machine, comprising:

a plurality of hydraulic actuators;

a plurality of pump devices connected to the plurality of hydraulic actuators via a plurality of hydraulic lines, and delivering hydraulic fluids in response to an operation amount of an operation device;

a plurality of hydraulic valves provided in the plurality of hydraulic lines, and changing over flows of the plurality of hydraulic lines in such a manner that the hydraulic fluids delivered from the plurality of pump devices are selectively supplied to the plurality of hydraulic actuators; and a controller that controls the pump devices and the hydraulic valves in response to the operation amount of the operation device, the controller including:

a demanded flow rate computing section that computes a demanded flow rate of each of the plurality of hydraulic actuators in response to the operation amount of the operation device;

a flow rate distribution section that computes a distribution flow rate of the hydraulic fluid supplied to each of the plurality of hydraulic actuators on the basis of the demanded flow rate; and a pump allocation computing section that computes a delivery flow rate of each of the plurality of pump devices in response to the distribution flow rate, wherein the flow rate distribution section includes:

a distribution region setting section that sets a distributable region for computing a range of a distributable flow rate that is a flow rate of the hydraulic fluid suppliable to each of at least two hydraulic actuators driven by a combined operation among the plurality of hydraulic actuators from the plurality of hydraulic pump devices for the at least two hydraulic actuators, and that sets a distribution region, within the distributable region, for computing a range of the distribution flow rate of the hydraulic fluid actually supplied to each of the at least two hydraulic actuators; and a ratio distribution section that computes the distribution flow rate in such a manner that when at least the demanded flow rate is out of the distributable region, the distribution flow rate falls within the distribution region and a ratio between the distribution flow rates of the at least two hydraulic actuators is equal to a ratio between the demanded flow rates of the at least two hydraulic actuators.

2. The drive system for a construction machine according to claim 1, wherein the distribution region setting section sets a range of the distribution region equal to a range of the distributable region.

3. The drive system for a construction machine according to claim 1, wherein the distribution region setting section sets the distribution region in such a manner that a maximum value of a sum of the distribution flow rates set to the at least two hydraulic actuators within a range of the distribution region is constant irrespective of the ratio between the demanded flow rates of the at least two hydraulic actuators.

4. The drive system for a construction machine according to claim 1, wherein the distribution region setting section sets the distribution region in such a manner that as the demanded flow rate of one of the at least two hydraulic actuators increases from a value indicating a fine operation, a declining rate of the distribution flow rate of at least one hydraulic actuator other than the one hydraulic actuator increases.

5. The drive system for a construction machine according to claim 1, wherein the flow rate distribution section further includes a scaling section that sets a ratio between the demanded flow rate and the distribution flow rate in such a manner that the distribution flow rate increases or decreases as the demanded flow rate increases or decreases, and that reduces the distribution flow rate computed by the ratio distribution section on the basis of the ratio.

* * * * *